US007882689B2

(12) United States Patent
Tada et al.

(10) Patent No.: US 7,882,689 B2
(45) Date of Patent: Feb. 8, 2011

(54) METHOD OF MANUFACTURING POWER TRANSMISSION CHAIN AND PRETENSION LOAD DEVICE USED IN MANUFACTURE OF POWER TRANSMISSION CHAIN

(75) Inventors: Seiji Tada, Kashiba (JP); Kozue Matsumoto, Kashiba (JP); Kazuo Rokkaku, Osaka (JP)

(73) Assignee: JTEKT Corporation, Osaka-shi, Osaka (JP)

( * ) Notice: Subject to any disclaimer, the term of this patent is extended or adjusted under 35 U.S.C. 154(b) by 453 days.

(21) Appl. No.: 12/010,549

(22) Filed: Jan. 25, 2008

(65) Prior Publication Data

US 2008/0196381 A1 Aug. 21, 2008

(30) Foreign Application Priority Data

Jan. 26, 2007 (JP) ..... P2007-016727

(51) Int. Cl.
*F16G 5/18* (2006.01)
*F16G 13/04* (2006.01)

(52) U.S. Cl. ..... 59/35.1; 59/8; 474/201; 474/229

(58) Field of Classification Search ..... 59/4, 59/5, 8, 35.1; 474/201, 214, 215, 216, 219, 474/221, 223, 224, 225, 229, 230
See application file for complete search history.

(56) References Cited

U.S. PATENT DOCUMENTS 4,581,001 A * 4/1986 Rattunde et al. ..... 474/214
4,927,404 A * 5/1990 Rattunde ..... 474/242
5,728,021 A * 3/1998 van Rooij et al. ..... 474/229
6,284,064 B1 9/2001 Fujiwara et al.
6,299,559 B1 * 10/2001 Friedmann ..... 474/242
6,383,105 B1 * 5/2002 Matsuno et al. ..... 474/213
6,406,396 B1 * 6/2002 Turner ..... 474/242
6,485,385 B2 * 11/2002 Shimaya ..... 474/213
6,824,484 B2 * 11/2004 Greiter ..... 59/8
7,617,668 B2 * 11/2009 Miura ..... 59/8
2003/0186767 A1 10/2003 Greiter

FOREIGN PATENT DOCUMENTS

DE 378845 8/1923
DE 100 18 132 A 1 11/2000
JP 2006-102784 4/2006
JP 2007-211914 8/2007

OTHER PUBLICATIONS

European Search Report dated May 27, 2007.

* cited by examiner

*Primary Examiner*—David B Jones
(74) *Attorney, Agent, or Firm*—McGinn IP Law Group, PLLC

(57) ABSTRACT

In the state where plural sheets of link plates which are single parts are laminated, tension for widening a distance between through-holes is loaded by a pair of pins which are inserted through the through-holes of the link plates so as to load pretension serving as a predetermined compressive residual stress on the link plates. Subsequently, the pair of pins are extracted from the link plates. Consequently, connection members are inserted through the corresponding through-holes of the plurality of link plates so as to assemble a chain with an endless shape.

13 Claims, 22 Drawing Sheets

METHOD OF MANUFACTURING POWER TRANSMISSION CHAIN AND PRETENSION LOAD DEVICE USED IN MANUFACTURE OF POWER TRANSMISSION CHAIN

BACKGROUND OF THE INVENTION

1. Field of the Invention

The present invention relates to a method of manufacturing a power transmission chain and a pretension load device used in a manufacture of the power transmission chain.

2. Related Art

For example, a power transmission chain with an endless shape used in a power transmission apparatus such as a pulley type continuously variable transmission (CVT) etc. of an automobile includes a link unit which is constituted by a plurality of link plates laminated in a width direction of the chain and a pin which connects the link plates of the link unit to each other (for example, see JP-A-2006-102784). A power is transmitted when both end surfaces of the pin engage with a pair of sheave surfaces of the pulley.

For example, as shown in JP-A-2006-102784, a strong tension to exceed a rated load is loaded on the power transmission chain during the manufacture so that a plastic deformation of the link plates occurs. Accordingly, a compressive residual stress is loaded thereon and work-hardening is provided in the link plate to improve a fatigue strength etc. Specifically, the chain is tensioned in the chain movement direction in the state where the chain is assembled in an endless shape so as to load the pretension.

However, in the case where the power transmission chain is configured such that the number of sheets of the link plates in each link unit is different or in the case where the power transmission chain is configured by using a plurality of link units of which the lengths of the link plates are different in the chain movement direction, plastic deformation amounts of the link plates tend to be non-uniform by loading the tension as described above. As a result, the compressive residual stress loaded on the link plates becomes non-uniform, and thus the strength improvement effect becomes non-uniform.

Additionally, the tension makes a large load that exceeds the rated load, and thus the end faces of the pin that receive the large load may be easily abraded.

SUMMARY OF THE INVENTION

The present invention is contrived in consideration of such a background, and an object of the invention is to suppress a non-uniformity of a compressive residual stress loaded on the link plate at the time of manufacturing a power transmission chain and to suppress an abrasion of the connection pin.

In order to achieve the above-described object, according to an aspect of the invention, there is provided a method of manufacturing a power transmission chain (1 and 1H). The method of manufacturing the power transmission chain (1 and 1H) includes a plurality of link plates (2 and 2H) which have a pair of through-holes (9 and 10) and which are arranged in a chain movement direction (X) and a plurality of connection members (50) which bendably connect the plurality of link plates (2 and 2H) to each other, the method comprising the steps of loading a force (F) for widening a distance between a pair of through-holes (9 and 10) by a pair of pins (28, 28B, 28D, 28E, 29, 29D, and 29G) inserted through the pair of through-holes in a state where one sheet of the link plate (2 and 2H) having the pair of through-holes (9 and 10) is disposed or plural sheets of the link plates (2 and 2H) having the pair of through-holes (9 and 10) are laminated so as to load pretension (σp) as a predetermined compressive residual stress on the one sheet of the link plate (2 and 2H) or plural sheets of the link plates (2 and 2H); extracting the pair of pins (28, 28B, 28D, 28E, 29, 29D, and 29G) from the link plate (2 and 2H); and inserting the connection members (50) through corresponding through-holes (9 and 10) of the plurality of link plates (2 and 2H) on which the pretension (σp) is loaded so as to assemble the power transmission chain (1 and 1H) (Aspect 1).

Arabic numerals in parenthesis show corresponding configuration components in the exemplary embodiments described below. Hereinafter, the same applies to the following Aspects.

According to the invention, since the pretension loaded on the link plates is uniform, it is possible to obtain a uniform strength improvement effect in the link plates. For example, at the time of using a plurality of link units of which the number of sheets of link plates is different or at the time of using a plurality of link plates of which the length in the chain movement direction is different, it is possible to prevent the pretension loaded on the link plates from being non-uniform. Additionally, since the connection member is not used at the time of loading the pretension, there is not a case where an abrasion of the connection member occurs due to a step of loading the pretension.

In the invention, during the step of loading the pretension (σp), each pin (28, 28B, 28D, 28E, 29, 29D, and 29G) may be rotated in a circumferential direction of an axial line thereof (L1 and L2) (Aspect 2). It is possible to increase the pretension loaded on the peripheral edge portion of the through-hole of the link plate.

In the invention, the method may further include a step of performing at least one of a barrel polishing, a shot blasting, and a shot peening on the link plate (2 and 2H) between the steps of extracting and assembling (Aspect 3). In this case, it is possible to load more pretension as a compressive residual stress on the surface of the link plate and to further increase strength of the link plate. In the case where a surface treatment such as the shot peening is carried out before loading the pretension by tensioning the link plate, the compressive residual stress that is loaded during the surface treatment becomes weak at the time of tensioning the link plate. However, such a problem does not occur.

In the invention, a pretension load device (24, 24A, 24B, 24C, 24D, 24E, 24F, and 24G) which is used in the step of loading the pretension as described above, the pretension load device including a pair of pins (28, 28B, 28D, 28E, 29, 29D, and 29G) which are inserted through a pair of through-holes (9 and 10) of the link plate (2 and 2H); and a distance enlargement mechanism (27, 40, 45*c*D, 46*c*D, and 41E) which widens a distance between the pair of through-holes (9 and 10) using the pair of pins (28, 28B, 28D, 28E, 29, 29D, and 29G) (Aspect 4). In this case, it is possible to load the pretension on the link plate with a simple configuration in which a distance between the pair of through-holes is widened.

In the invention, the distance enlargement mechanism (27 and 40) may include a tension mechanism (27 and 40) which tensions the pair of pins (28, 28B, and 29) in a direction moving away from each other (Aspect 5). In this case, it is possible to widen a distance between the pair of through-holes with a simple configuration in which the pair of pins are tensioned in a direction where moving away from each other.

In the invention, the pretension load device may further include a base (25) having an insertion through-hole (32*a* and 32*b*) through which one (28) of the pair of pins (28 and 29) is inserted, and the tension mechanism (27) may include a drive mechanism (27) which drives the base (25) in a direction where one pin (28) moves away from the other pin (29) (Aspect 6). In this case, it is possible to tension the pair of pins in a direction moving away from each other through the base.

In the invention, the pretension load device may further include a base (25) having an insertion through-hole (32*a*B and 32*b*B) through which one (28B) of the pair of pins (28B and 29) is inserted, and the tension mechanism (40) may include a cam mechanism (40) which converts a force for inserting one pin (28B) to the insertion through-hole (32*a*B and 32*b*B) of the base (25) into a force (F) for moving the one pin (28B) away from the other pin (29) (Aspect 7). In this case, it is possible to tension the pair of pins in a direction moving away from each other at the same time one pin is inserted to the base, and thus it is possible to reduce a time for loading the pretension.

In the invention, the distance enlargement mechanism (45*c*D, 46*c*D, and 41E) may include a cam mechanism (45*c*D, 46*c*D, and 41E) which converts a force for inserting at least one of the pair of pins (28D, 28E, 29, 29D, and 29G) to the corresponding through-hole (9 and 10) of the link plate (2 and 2H) into a force (F) for widening a distance between the pair of through-holes (9 and 10) (Aspect 8). In this case, it is possible to widen a distance between the pair of through-holes at the same time the pin is inserted to the corresponding through-hole of the link plate, and thus it is possible to further reduce a time for loading the pretension.

In the invention, the pretension load device may further include a rotation mechanism (30 and 31) which rotates the pin (28, 28B, 28D, 28E, 29, 29D, and 29G) in a circumferential direction of an axial line thereof (L1 and L2) (Aspect 9). In this case, it is possible to further increase the pretension loaded on the peripheral edge portion of the through-hole of the link plate.

DETAILED DESCRIPTION OF THE PREFERRED EMBODIMENTS

An exemplary embodiment of the invention will be described with reference to the accompanying drawings.

Figure 1:
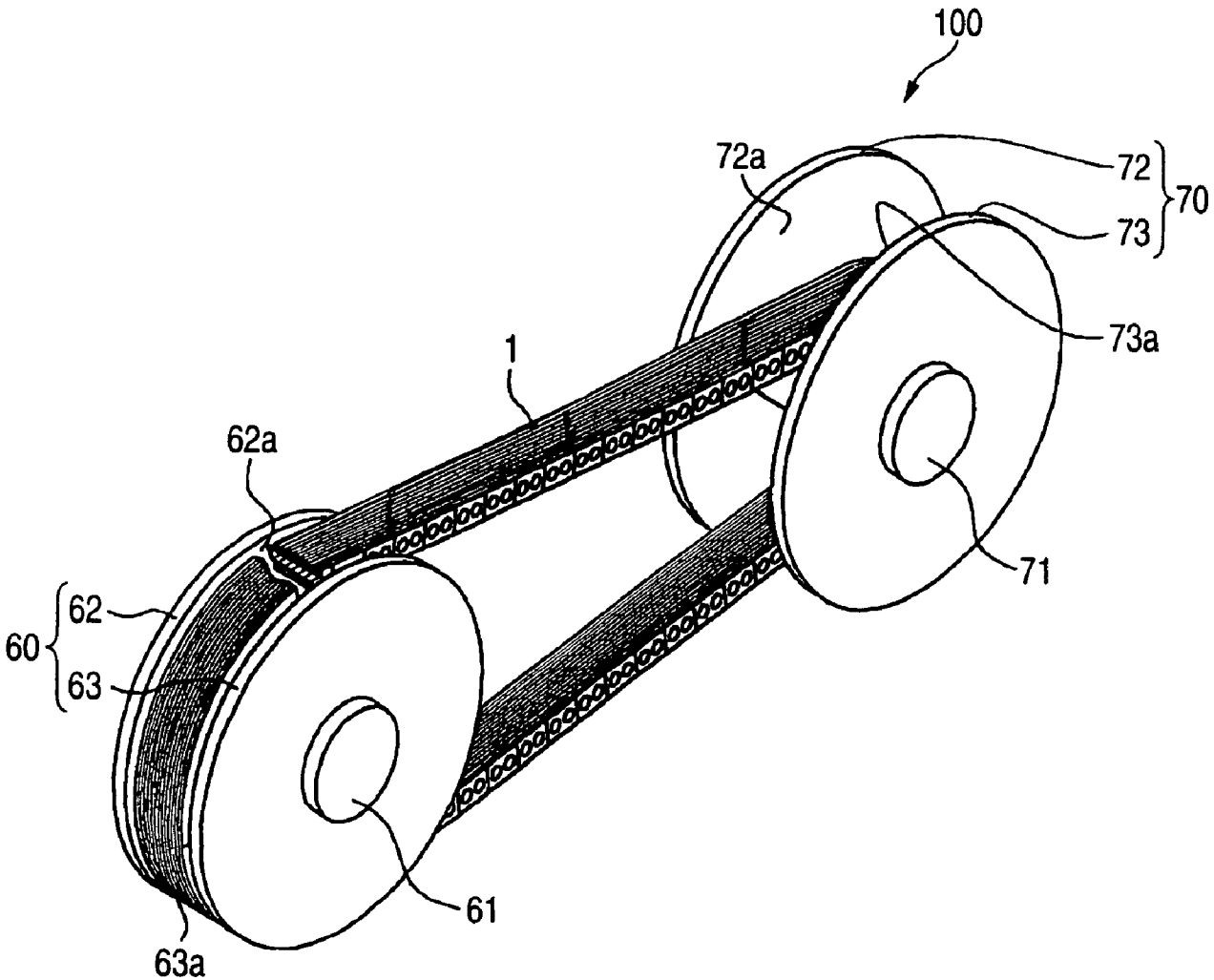
FIG. 1 is a perspective view schematically illustrating a configuration of a main part of a chain type continuously variable transmission serving as a power transmission apparatus having a power transmission chain according to one embodiment of the invention.

FIG. 1 is a perspective view schematically illustrating a configuration of a main part of a chain type continuously variable transmission (hereinafter, simply referred to as continuously variable transmission) serving as a power transmission apparatus including a power transmission chain according to one embodiment of the invention. As shown in FIG. 1, a continuously variable transmission 100 is mounted in a vehicle such as an automobile and includes a drive pulley 60 which serves as a first pulley and is made of metal (structural steel etc.), a driven pulley 70 which serves as a second pulley and is made of metal (structural steel etc.), and a continuous power transmission chain 1 (hereinafter, simply referred to as a chain) which are wound around both of the pulleys 60 and 70. Incidentally, FIG. 1 is a sectional view partially illustrating the chain 1 for an easy understanding.

Figure 2:
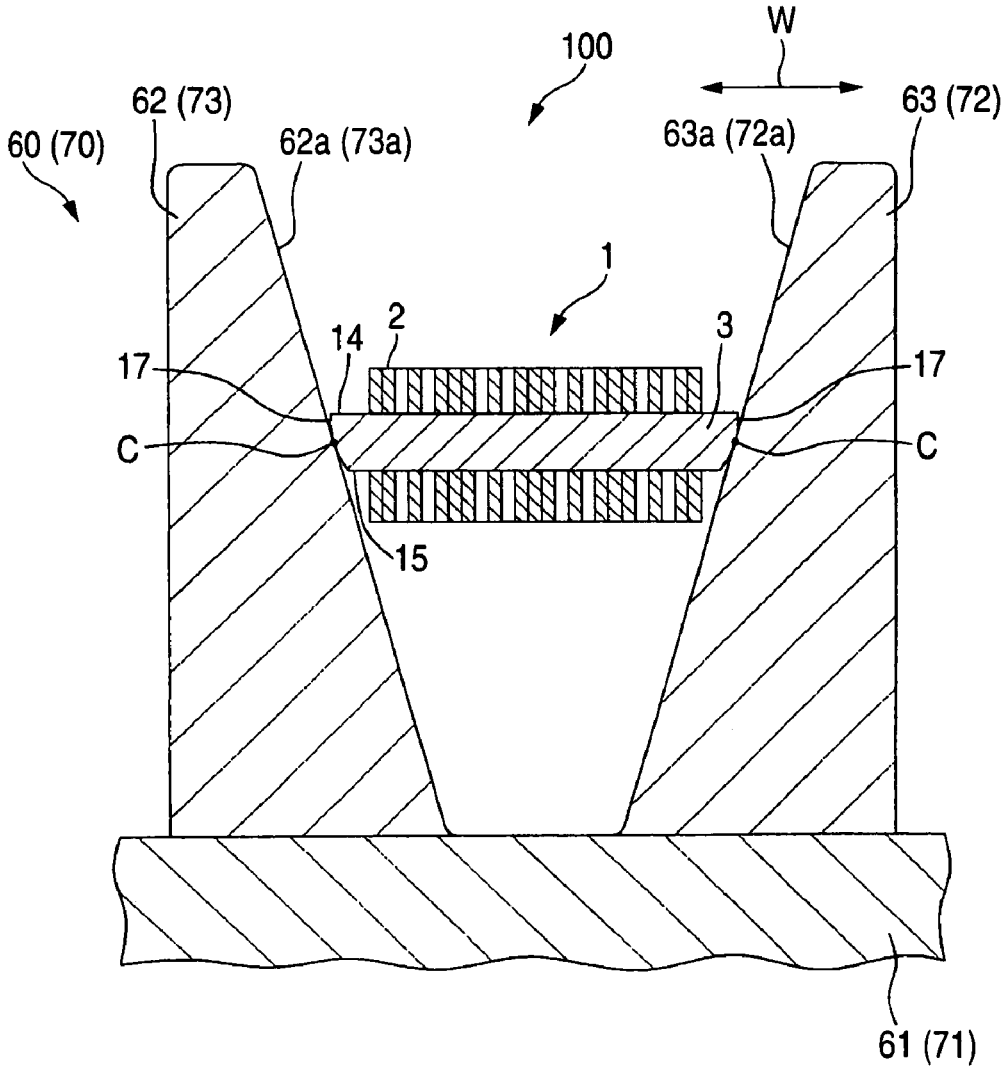
FIG. 2 is a partially enlarged sectional view illustrating a drive pulley (driven pulley) shown in FIG. 1.

FIG. 2 is a partially enlarged sectional view illustrating the drive pulley 60 (driven pulley 70) and the chain 1 shown in FIG. 1. As shown in FIGS. 1 and 2, the drive pulley 60 is attached to an input shaft 61, which is connected to a drive source of a vehicle to transmit a power, so as to be integrally rotatable and includes a stationary sheave 62 and a movable sheave 63. The stationary sheave 62 and the movable sheave 63 include a pair of sheave surfaces 62*a* and 63*a* which is opposes to each other. Each of the sheave surfaces 62*a* and 63*a* includes a slope surface with a conical shape. A groove is defined between the sheave surfaces 62*a* and 63*a*, and the chain 1 is configured to be forcedly fitted and held in the groove.

Additionally, the movable sheave 63 is connected to a hydraulic actuator (not shown) for changing a groove width, and the groove width is configured to be changed by moving the movable sheave 63 in the axial direction (in the left and right direction shown in FIG. 2) of the input shaft 61 at the time of changing the speed. Accordingly, it is possible to change an effective radius (hereinafter, referred to as an effective radius of the pulley 60) of the pulley 60 with respect to the chain 1 by moving the chain 1 in the diameter direction (in the up and down direction shown in FIG. 2) of the input shaft 61.

Meanwhile, as shown in FIGS. 1 and 2, the driven pulley 70 is attached to an output shaft 71, which is connected to a drive wheel (not shown) to transmit a power, so as to be integrally rotatable. At this time, in the same manner as the drive pulley 60, the driven pulley 70 includes a stationary sheave 73 and a movable sheave 72 having a pair of sheave surfaces 73*a* and 72*a* which are opposed to each other to form a groove to which the chain 1 is forcedly fitted.

The movable sheave 72 of the driven pulley 70 is connected to a hydraulic actuator (not shown) in the same manner as the movable sheave 63 of the drive pulley 60 and is configured to change the groove width by moving the movable sheave 72 at the time of changing a speed. Accordingly, it is possible to change the effective radius (hereinafter, referred to as an effective radius of the pulley 70) of the pulley 70 with respect to the chain 1 by moving the chain 1.

Figure 3:
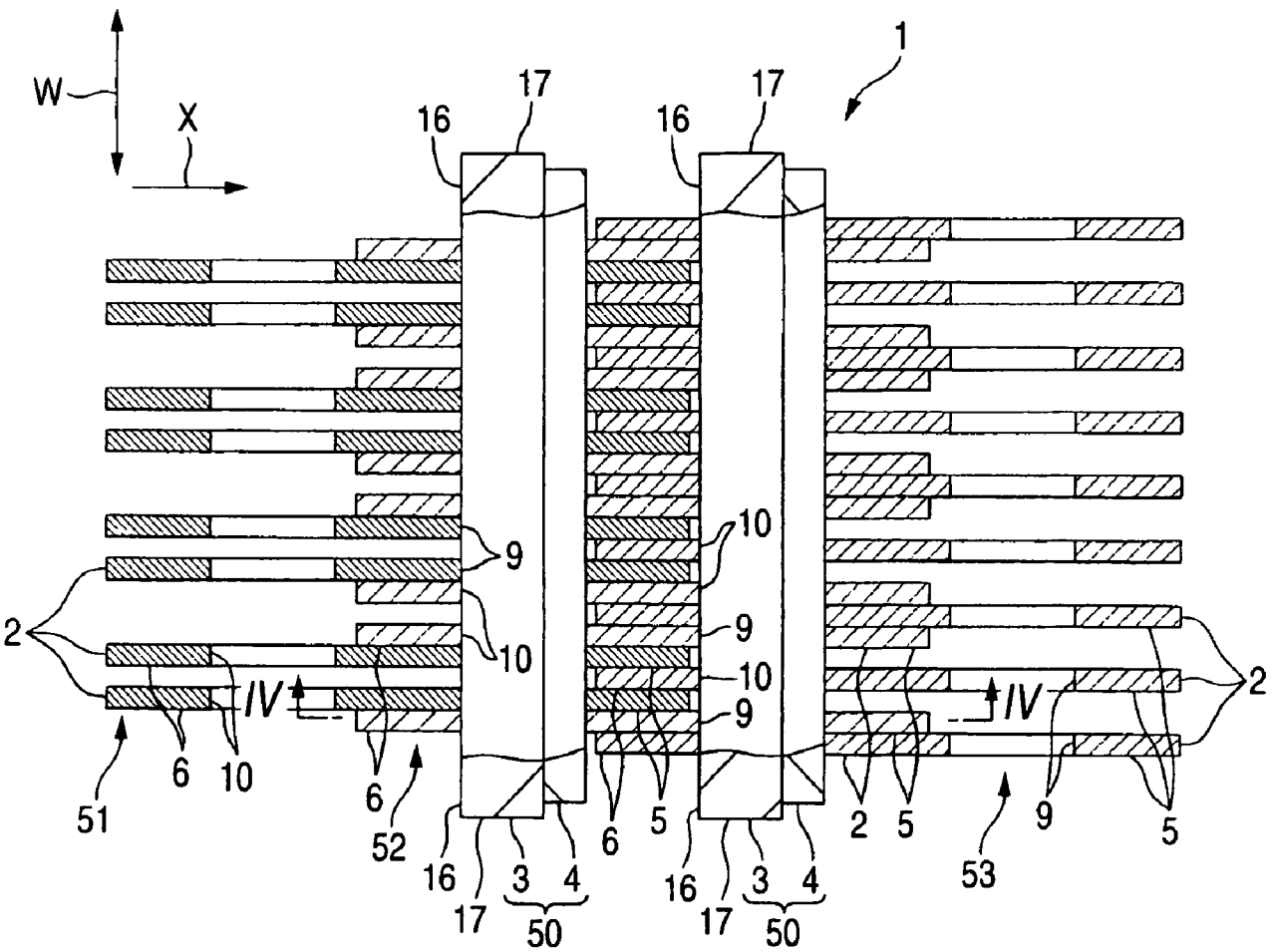
FIG. 3 is a partially sectional view illustrating a main part of a chain.
Figure 4:
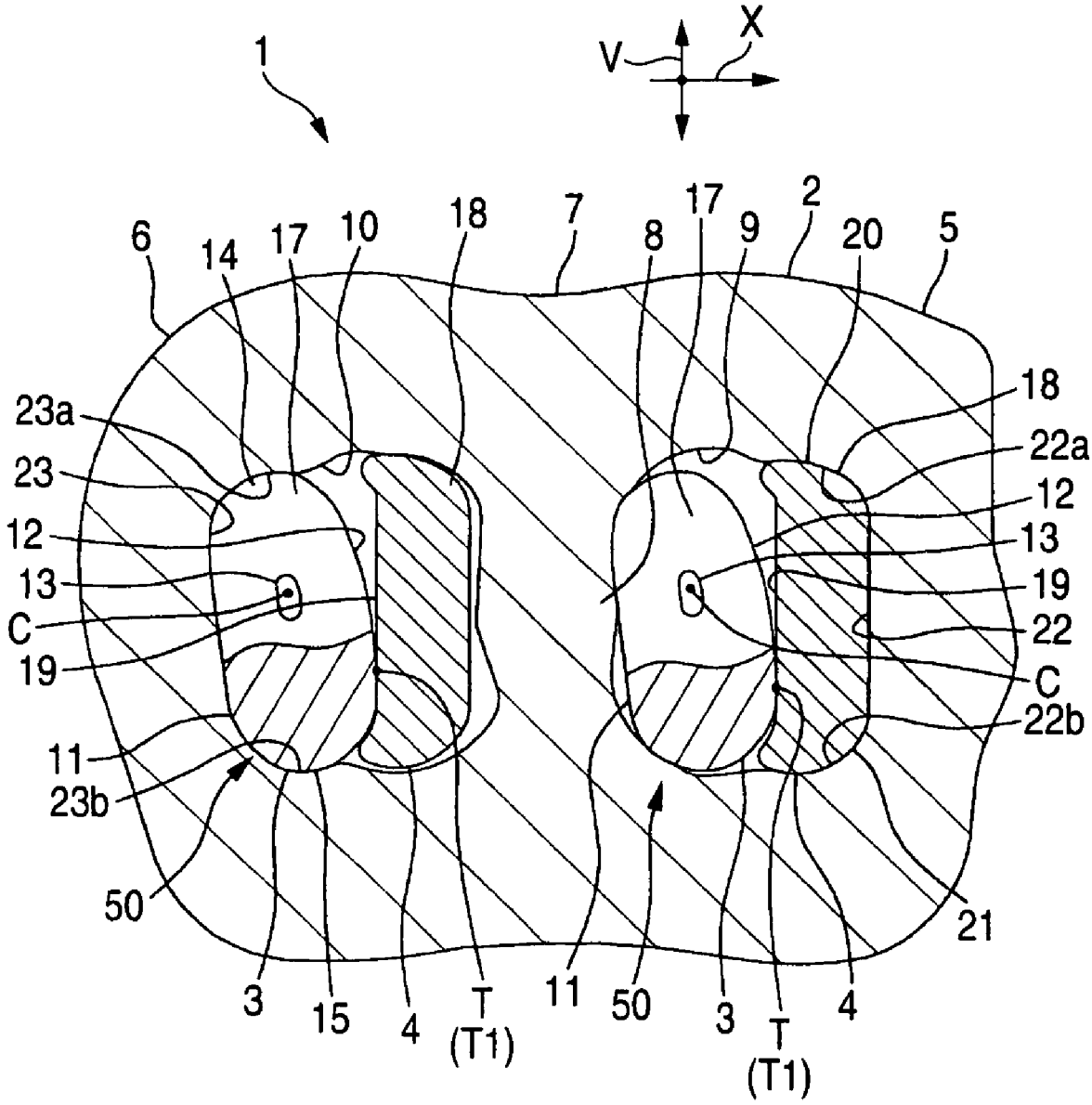
FIG. 4 is a partially sectional view taken along the line IV-IV shown in FIG. 3.

FIG. 3 is a partially sectional view illustrating a main part of the chain 1. FIG. 4 is a partially sectional view taken along the line IV-IV shown in FIG. 3. As shown in FIGS. 3 and 4, the chain 1 includes a plurality of link plates 2 and a plurality of connection members 50 which bendably connect the link plates 2.

Hereinafter, a direction where the chain 1 moves is denoted by a chain movement direction X, a direction which is perpendicular to the chain movement direction X and which follows the longitudinal direction of the connection members 50 is denoted by a chain width direction W, and a direction which is orthogonal to the chain movement direction X and the chain width direction W is denoted by an orthogonal direction V.

Each of the link plates 2 is made of a steel sheet by pressing, and includes a front end portion 5 and a rear end portion 6 which correspond to a pair of end portions and which are arranged in front and rear of the chain movement direction X, and an intermediate portion 7 which is disposed between the front end portion 5 and the rear end portion 6.

The front end portion 5 or the rear end portion 6 is provided with a front through-hole 9 which serves as one of a pair of through-holes and a rear through-hole 10 which serves as the other of the pair of through-holes. The intermediate portion 7 includes a column portion 8 which defines a boundary between the front through-hole 9 and the rear through-hole 10.

First to third link units 51 to 53 are formed by the link plates 2. Specifically, the first link unit 51, the second link unit 52, and the third link unit 53 include a plurality of link plates 2 which are arranged in the chain width direction W, respectively. For example, the first link unit 51 includes eight sheets of link plates 2, the second link unit 52 includes eight sheets of link plates 2, and the third link unit 53 includes nine sheets of link plates 2. Likewise, a plurality of link units having the link plates 2 of which the number of the sheets is different from each other are used.

In the first to third link units 51 to 53, the link plates 2 of the same link unit are aligned so that positions are the same in the chain movement direction X. The first to third link units 51 to 53 are sequentially arranged in the chain movement direction X.

Each of the link plates 2 of the first to third link units 51 to 53 is connected to the corresponding link plate 2 of the first to third link units 51 to 53 so as to relatively rotate (to be bendable) using the corresponding connection member 50.

Specifically, the link plates 2 of the link units are bendably connected to each other by the connection members 50 which are inserted through both of the front through-hole 9 of one link unit and the rear through-hole 10 of the link unit corresponding to the former link unit.

In FIG. 3, only one of the first to third link units 51 to 53 are shown, respectively, but the first to third link units 51 to 53 are arranged repeatedly in the chain movement direction X, so that the chain 1 is formed in an endless shape.

As shown in FIGS. 3 and 4, each of the connection members 50 includes a pair of first and second pins 3 and 4. The first and second pins 3 and 4 come into rolling and sliding contact with each other at the time the link plates 2 are bended. The rolling and sliding contact means that a contact includes at least one of the rolling contact and the sliding contact.

The first pin 3 is a longitudinal member which extends in the chain width direction W. A circumferential surface 11 of the first pin 3 is formed in a smooth surface, and includes a front portion 12 which faces the front side of the chain movement direction X and one end portion 14 and the other end portion 15 which correspond to a pair of end portions opposed to each other in the orthogonal direction V.

The front portion 12 is opposed to the second pin 4 and comes into rolling and sliding contact with a rear portion 19, which is described below, of the second pin 4 at a contact portion T (a contact point when viewed from the chain width direction W).

A pair of end portions 16 with respect to the longitudinal direction (chain width direction W) of the first pin 3 protrude from the link plate 2, which is disposed in a pair of end portions in the chain width direction W, in the chain width direction W, respectively. At this time, each of the end portions 16 is provided with an end surface 17 serving as a power transmission portion.

As shown in FIGS. 2 and 4, a contact region 13 with an elliptical shape of each end surface 17 engages with the corresponding sheave surfaces 62*a*, 63*a*, 72*a*, and 73*a* of each of the pulleys 60 and 70 through a lubricant oil film so as to transmit a power. The center of the contact region 13 is denoted by a contact center point C. Since the end surface 17 of the first pin 3 is directly involved with a power transmission, the first pin 3 is made of a material such as a bearing steel (SUJ2) with high strength and excellent abrasion resistance.

As shown in FIGS. 3 and 4, the second pin 4 (which is referred to as strip or interpiece) is a longitudinal member which is made of the same material as that of the first pin 3 and which extends in the chain width direction W. The second pin 4 is formed to be smaller than the first pin 3 so that a pair of end portions does not come into contact with the sheave surface of each pulley.

A circumferential surface 18 of the second pin 4 is formed in a smooth surface, and includes a rear portion 19 which faces the back side of the chain movement direction X and one end portion 20 and the other end portion 21 which correspond to a pair of end portions with respect to the orthogonal direction V.

The rear portion 19 includes a flat surface which is perpendicular to the chain movement direction X, and the flat surface comes into contact with the corresponding front portion 12 of the first pin 3 at the contact portion T.

The chain 1 is a so-called press-fit type chain. Specifically, the first pin 3 is loosely inserted in the front though-hole 9 of each of the link plates 2 so as to relatively move, and the second pin 4 is press-fitted and fixed in the front through-hole 9, and on the other hand, the first pin 3 is press-fitted and fixed in the rear through-hole 10 of the link plate 2 to be fitted thereto, and the second pin 4 is loosely inserted in the rear through-hole 10 so as to be relatively movable.

In a peripheral edge portion 22 of the front through-hole 9, first and second portions 22*a* and 22*b* which are opposed to one end portion 20 and the other end portion 21 of the second pin 4 come into pressing contact with one end portion 20 and the other end portion 21. In the same manner, in a peripheral edge portion 23 of the rear through-hole 10, first and second portions 23*a* and 23*b* which are opposed to one end portion 14 and the other end portion 15 of the first pin 3 come into pressing contact with one end portion 14 and the other end portion 15.

A portion of the front portion 12 of the first pin 3 which can come into contact with the flat surface of the rear portion 19 of the second pin 4 is formed in an involute curve shape when viewed from the chain width direction W. In the involute curve, a curvature radius on the side of the other end portion 15 corresponding to the inner diameter of the chain is set to be relatively small and a curvature radius on the side of one end portion 14 corresponding to the outer diameter of the chain is set to be relatively large. Accordingly, when the link plates 2 which are adjacent to each other are bended, the corresponding first and second pins 3 and 4 can smoothly come into rolling contact with each other, and thus it is possible to realize a smooth bend between the link plates 2.

Additionally, the front portion 12 of the first pin 3 when viewed from the chain width direction W may be formed in a curve shape (for example, a curve having a single curvature radius or a plurality of curvature radiuses) other than the involute curve shape.

The embodiment is characterized in that pretension σp acting as a predetermined compressive residual stress for improving strength is loaded equally on each of the link plates 2. The pretension σp is applied at the time of manufacturing the chain 1, and the pretension σp is loaded by work-hardening the link plate 2 so that fatigue strength, abrasion resistance, impact resistance, etc. are improved to thereby improve durability.

Hereinafter, a manufacture of the chain 1 will be described.

Figure 5A:
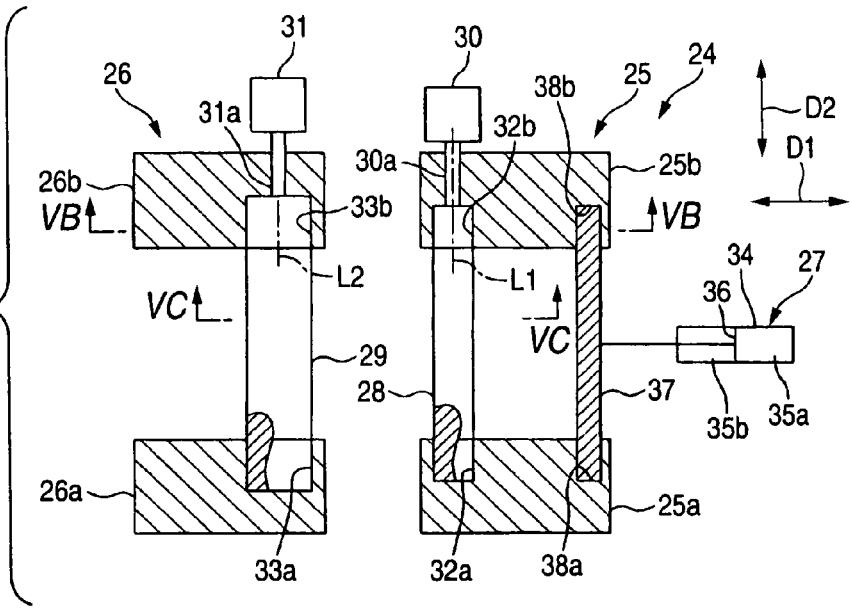
FIG. 5A is a partially sectional view schematically illustrating a schematic configuration of a pretension load device for loading pretension on a link plate.

FIG. 5A is a partially sectional view schematically illustrating a configuration of a pretension load device 24 for loading pretension on the link plate 2. As shown in FIG. 5A, the pretension load device 24 includes a pair of drive members 25 serving as a base, a pair of driven members 26, a hydraulic cylinder 27 serving as drive means for driving the pair of drive members 25, a pair of pins 28 and 29, and rotation mechanisms 30 and 31 for rotating the pins 28 and 29 in the circumferential direction of the axial lines L1 and L2.

The pair of drive members 25 and the pair of driven members 26 can move relatively in a predetermined first direction D1 corresponding the chain movement direction X, and can move away or close from or to each other.

One drive member 25*a* and the other drive member 25*b* can move relatively in a second direction D2 perpendicular to the first direction D1, and can move away or close form or to each other. The second direction D2 corresponds to the chain width direction W. Corresponding end portions of one pin 28 are inserted through insertion through-holes 32*a* and 32*b* formed in one drive member 25*a* and the other drive member 25*b*, respectively, so as to relatively rotate.

One driven member 26*a* and the other driven member 26*b* can move relatively in the second direction D2, and can move away or close from or to each other. Corresponding end portions of the other pin 29 are inserted through insertion through-holes 33*a* and 33*b* formed in one driven member 26*a* and the other driven member 26*b*, respectively, so as to be relatively rotatable.

The hydraulic cylinder 27 is configured to drive the pair of drive members 25 in the first direction D1, and serves as a distance enlargement mechanism (a tension mechanism for tensioning a pair of pins so as to move away from each other and a drive mechanism for driving a base in a direction where one pin moves away from the other pin) for widening a distance between a pair of through-holes of the link plate. The hydraulic cylinder 27 includes a cylinder main body 34 with a cylindrical shape, a piston 36 for defining the inside of the cylinder main body 34 into two of first and second oil chambers 35*a* and 35*b*, and a connection member 37 for connecting the piston 36 to the pair of drive members 25.

The connection member 37 is detachably inserted through the insertion through-holes 38*a* and 38*b* formed in one drive member 25*a* and the other drive member 25*b*, respectively. When the hydraulic cylinder 27 is driven, the pair of drive members 25 relatively move with respect to the pair of driven members 26 in the first direction D1.

Each of the rotation mechanisms 30 and 31 includes, for example, an electric motor and a deceleration mechanism (not shown), and an output rotation of the electric motor is decelerated by the deceleration mechanism so as to be output from corresponding output shafts 30*a* and 31*a*. The output shafts 30*a* and 31*a* are inserted through the other drive member 25*b* and the other driven member 26*b*, respectively, and are connected to the corresponding one end portions of the pins 28 and 29, respectively, so as to be integrally rotatable.

Figure 5B:
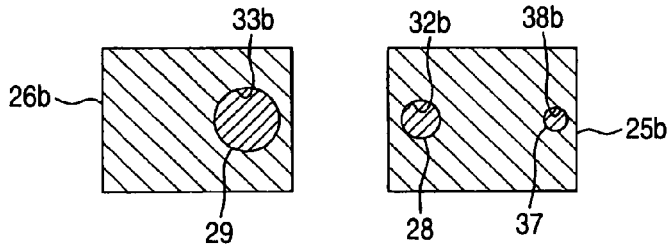
FIG. 5B is a sectional view taken along the line VB-VB shown in FIG. 5A.
Figure 5C:
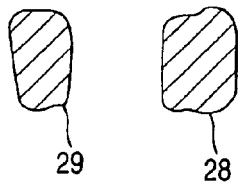
FIG. 5C is a sectional view taken along the line VC-VC shown in FIG. 5A.

Each portion of the pair of pins 28 and 29 which are inserted through the through-holes 32*a* and 32*b* and the through-holes 33*a* and 33*b*, respectively is formed in a circular shape in a sectional view as shown in FIG. 5B. Each intermediate portion of the pair of pins 28 and 29 in the longitudinal direction undulates in the circumferential direction as shown in FIG. 5C.

Figure 6:
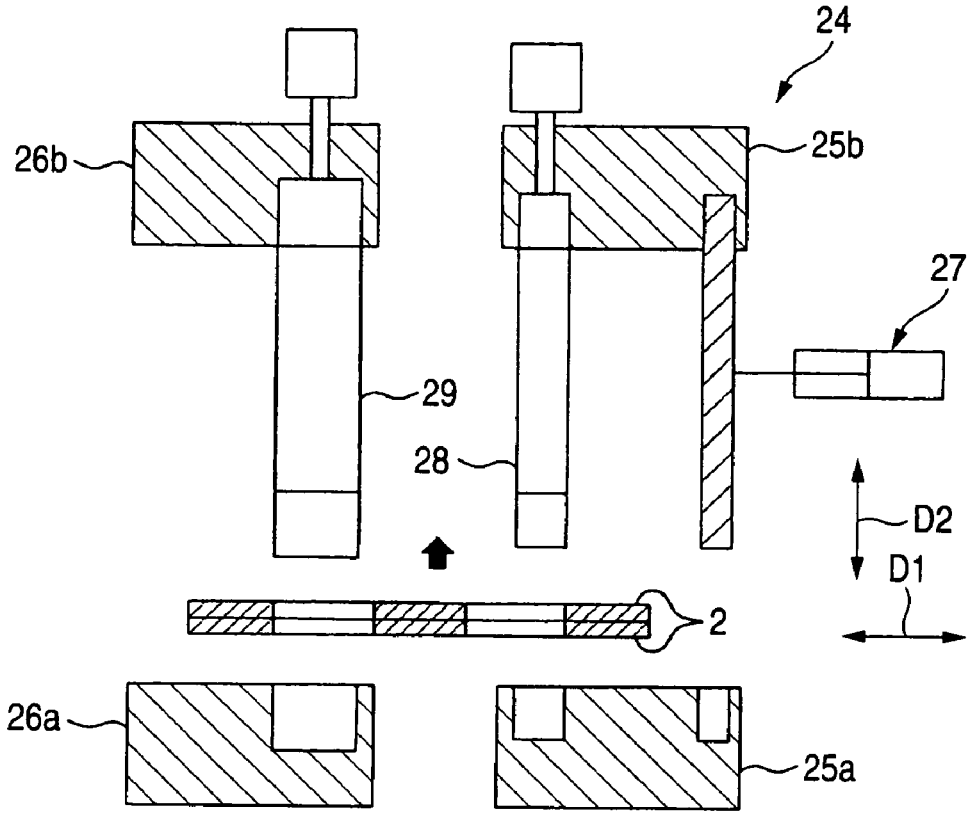
FIG. 6 is a view illustrating a state where a pretension load device loads pretension on the link plate.

A manufacture of the link plate 2 is carried out as below. That is, as shown in FIG. 6, one drive member 25*a* and one driven member 26*a* of the pretension load device 24 are first made to move away from the other drive member 25*b* and the other driven member 26*b* in the second direction D2. At this time, the pair of pins 28 and 29 are held in the other drive member 25*b* and the other driven member 26*b*, respectively.

Figure 8:
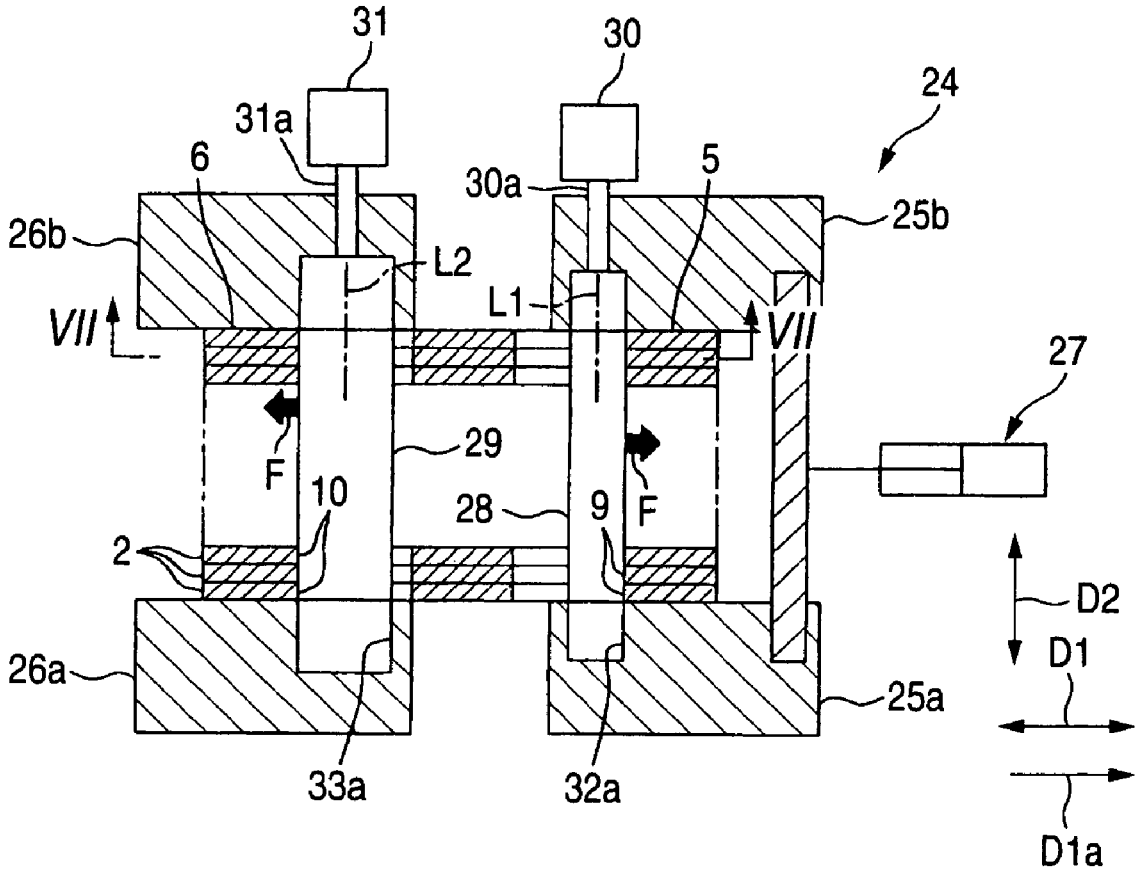
FIG. 8 is a view illustrating a state where the pretension load device loads pretension on the link plate.

Subsequently, plural sheets of the link plates 2 which are formed such that a steel sheet (material) of SK85 (SK5) etc. of JIS (Japanese Industrial Standard) is subjected to pressing and a predetermined heat treatment are laminated, and then the pair of pins 28 and 29 are inserted through the link plates 2. Specifically, as shown in FIG. 8, one pin 28 is inserted through the front through-holes 9 of the link plates 2, and then the other pin 29 is inserted through the rear through-holes 10. Additionally, the number of the link plates 2 through which the pair of pins 28 and 29 are inserted may be one sheet.

The pair of pins 28 and 29 are tightly inserted through the corresponding through-holes 9 and 10. The pair of pins 28 and 29 come into pressing contact with the first portion 22*a* and 22*b* and the second portion 23*a* and 23*b* of the peripheral edge portions 22 and 23 of the corresponding through-holes 9 and 10. Additionally, the pair of pins 28 and 29 may be inserted through the corresponding through-holes 9 and 10 so as to be loosely inserted therein.

The pair of pins 28 and 29 can be substantially treated as complete rigid bodies in that a sufficient rigidity (strength) having a section area of a predetermined size is ensured within the corresponding through-holes 9 and 10.

Subsequently, as shown in FIG. 8, one drive member 25*a* and one driven member 26*a* are moved in the second direction D2, and then the corresponding pins 28 and 29 are inserted through the through-holes 32*a* and 33*a*, respectively. By the pair of drive member 25 and the pair of driven members 26, plural sheets of link plates 2 are clamped therebetween.

In this state, when the hydraulic cylinder 27 is driven so as to drive the pair of drive members 25 in one side D1*a* of the first direction D1 and to load a force for moving the pair of drive members 25 away from the pair of driven members 26. At this time, a movement of the pair of driven members 26 in the first direction D1 is restricted by a restriction member (not shown) etc. Accordingly, when a tension F for moving one pin 28 away from the other pin 29 is loaded, the distance between the pair of through-holes 9 and 10 is widened and the pretension σp serving as a predetermined compressive residual stress is loaded on the link plates 2.

At this time, a tension F is set so that a stress (e.g., a stress exceeding 1,100 N/mm$^2$) exceeding an elastic limit is applied to each of the link plates 2.

Further, the output shafts 30*a* and 31*a* of the rotation mechanisms 30 and 31 are driven to rotate while the tension F is loaded, so that the pair of pins 28 and 29 are turned around the axial lines L1 and L2, respectively. At this time, the turning angles are about 3° in one side and the other side of the movement directions B1 and B2 on the basis of the state (a state where the pair of pins 28 and 29 come into pressing contact with the corresponding first portions 22*a* and 22*b* and the corresponding second portions 23*a* and 23*b*) shown in FIG. 7.

Figure 7:
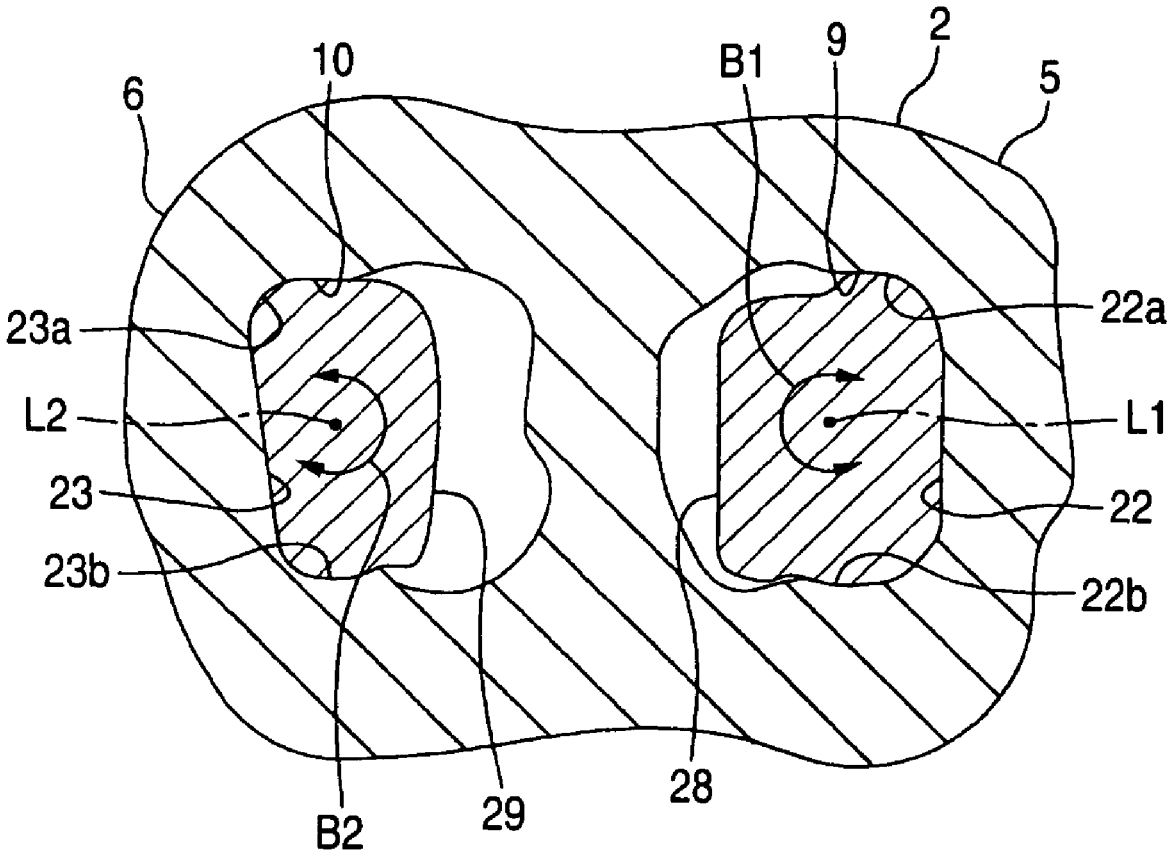
FIG. 7 is a view illustrating a state where the pretension load device loads pretension on the link plate.

As shown in FIGS. 7 and 8, the rotation mechanisms 30 and 31 are driven so that the pair of pins 28 and 29 more strongly come into pressing contact with the peripheral edge portions 22 and 23 of the corresponding through-holes 9 and 10.

Figure 9:
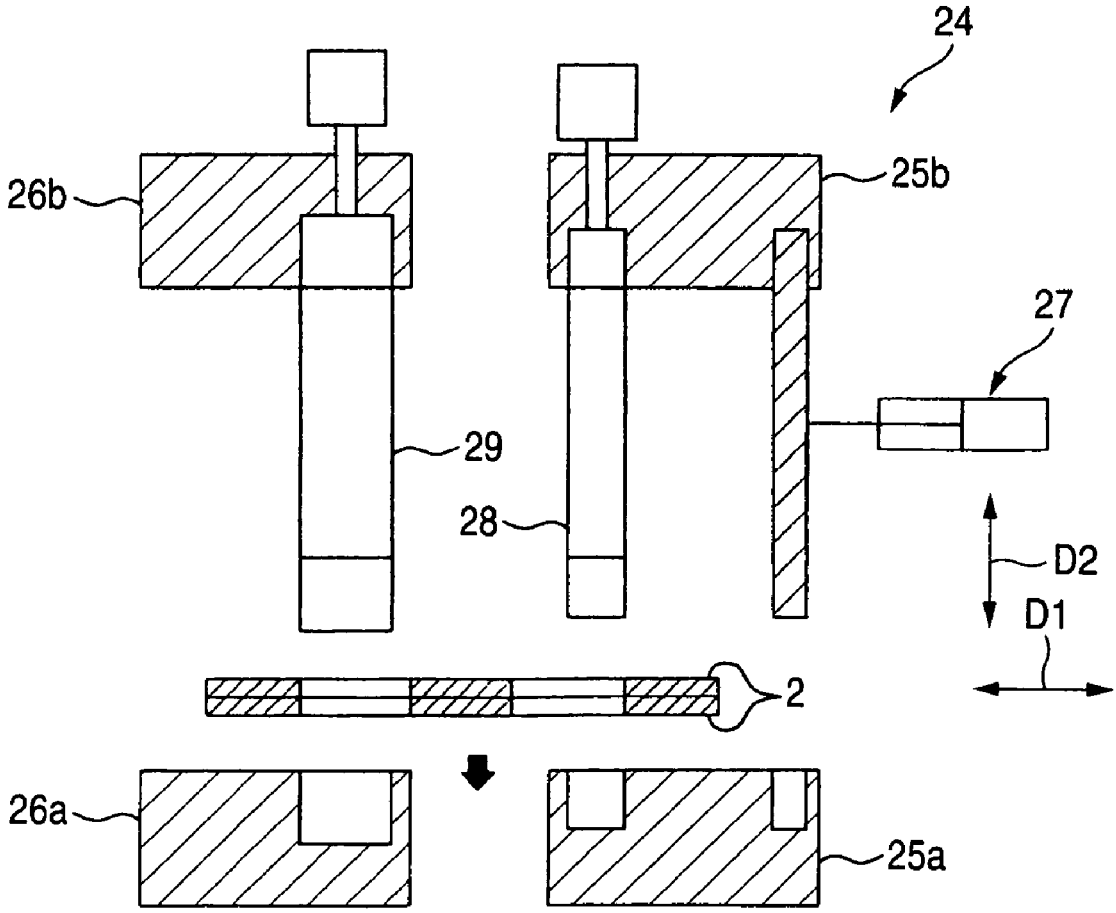
FIG. 9 is a view illustrating a state where the pretension load device loads pretension on the link plate.

After a predetermined time elapses from a drive start of the rotation mechanisms 30 and 31, the drive of the rotation mechanisms 30 and 31 is stopped and the tension F loaded by the hydraulic cylinder 27 is released. Additionally, as shown in FIG. 9, one drive member 25*a* and one driven member 26*a* are moved in the second direction D2, a fitting state with the corresponding pins 28 and 29 is released and then the link plates 2 are extracted from the pins 28 and 29.

Figure 10:
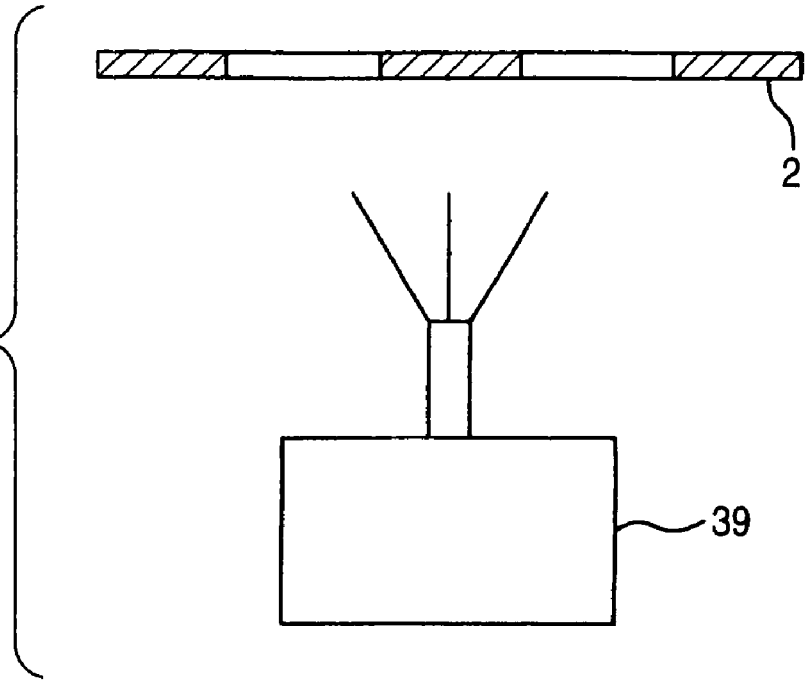
FIG. 10 is a view illustrating a state where a shot peening device loads pretension on the link plate.

As shown in FIG. 10, a shot peening is performed on the surfaces of the link plates 2 extracted from the pins 28 and 29 by using a shot peening device 39. Accordingly, the pretension σp is further loaded on the surfaces of the link plates 2.

The pretension σp loaded on the link plates 2 after the above-described work is, for example, in the range of about 500 N/mm$^2$ to 1,500 N/mm$^2$.

Figure 11:
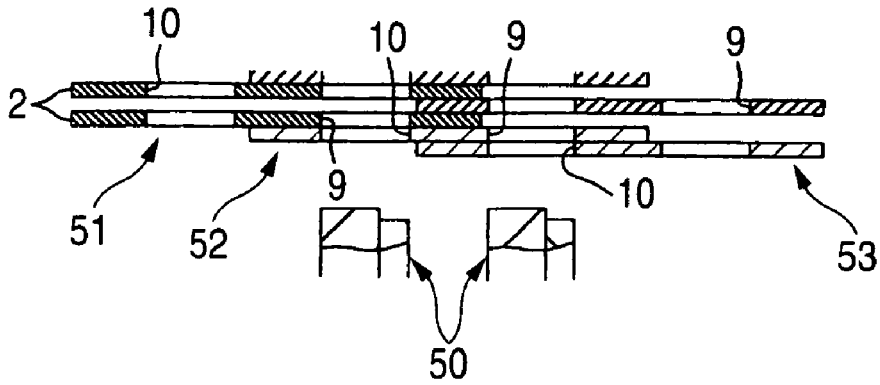
FIG. 11 is a view illustrating a step of assembling the chain.

As shown in FIG. 11, plural sheets of the link plates 2 on which the shot peening is performed are laminated to thereby configure a link unit (e.g., the first link unit 51, the second link unit 52, and the third link unit 53 exemplified in FIG. 11), and the connection members 50 are inserted through the front through-hole 9 and the rear through-hole 10 of the link plates 2 of the link units. Each link unit is connected to the corresponding link unit by the connection members 50, so that a chain is assembled in an endless shape.

According to the embodiment, the following effects and advantages can be obtained. That is, the pretension σp loaded on the link plates 2 is made to be uniform by using the pretension load device 24 and the shot peening device 39. Accordingly, it is possible to uniformly improve strength in the link plates 2 by the pretension σp.

Even when various link units 51 to 53 of which the number of sheets of the link plates is different are used, it is possible to prevent the pretension σp loaded on the link plates 2 from being non-uniform. Additionally, since the connection members 50 are not used at the time of loading the pretension σp, there is not a case where abrasion of the connection member 50 (the end surface 17 of the first pin 3) occurs due to the load work of the pretension σp.

Since the pins 28 and 29 are rotated (turned) around the axial lines L1 and L2, it is possible to set the pretension σp loaded on the peripheral edge portions 22 and 23 of the through-holes 9 and 10 of the link plate 2 to be larger.

In the same manner as the case where the pretension is loaded by loading a tension while the chain 1 is bended by a predetermined bended angle, it is possible to allow a plastic deformation amount of the peripheral edge portions 22 and 23 of the through-holes 9 and 10 of the link plate 2 to be larger. In particular, it is possible to remarkably improve a strength of the first portions 22*a* and 22*b* and the second portions 23*a* and 23*b* where the corresponding first and second pins 3 and 4 are press-fitted to increase a stress (load), in the peripheral edge portions 22 and 23 of the through-holes 9 and 10.

Additionally, after the pretension σp is loaded on the link plates 2 by the pretension load device 24, a short peening is performed on the link plates 2. Accordingly, it is possible to further load the pretension σp on the surfaces of the link plates 2 and it is possible to further improve the strength of the link plates 2.

For example, in the case where the link plate is subjected to a shot peening before the tension pretension load, the loaded compressive residual stress becomes weak in a step of tensioning the link plate. However, such a problem does not occur.

Additionally, with a simple configuration in which the pretension load device 24 widens a distance between the pair of through-holes 9 and 10 of the link plates 2, it is possible to load the pretension σp on the link plates 2. Further, the simple configuration may be configured to tension the pair of pins 28 and 29 to move away from each other.

Additionally, the hydraulic cylinder 27 drives the pair of drive members 25 in the direction where one pin 28 moves away from the other pin 29. In this way, it is possible to tension the pair of pins 28 and 29 to move away from each other using the pair of drive members 25.

In addition, since the pretension σp for one sheet is controlled by increasing or decreasing the number of sheets of the link plates 2 which are tensioned by the pretension load device 24 at one time, it is possible to load the pretension σp in accordance with an allowable transmission torque of the chain 1 on the link plates 2. Accordingly, even when the allowable transmission torque of the chain 1 is relatively small to be less than 100 Nm or relatively large to be 1,000 Nm or 2,000 Nm, it is possible to load the appropriate pretension σp using one unit of the pretension load device 24.

Differently from a configuration in which the whole chain is tensioned by a pair of pulleys so as to load pretension on all links of the chain at one time, in the embodiment, the pretension σp is loaded on the link plate 2 which is a single part. Accordingly, a necessary pretension F may be relatively small, and it is possible to compact the size of the pretension load device 24.

In the configuration in which the pretension is loaded by tensioning the whole chain using a pair of pulleys, the first and second pins of the connection members are bent by a tension.

As a result, pretension loaded on the link plates in a chain width direction becomes non-uniform. However, according to the embodiment, the pretension σp of the link plates 2 is controlled to be uniform, and thus such a non-uniformity of pretension does not occur.

The first pin 3 corresponding to the front through-hole 9 is loosely inserted, and the second pin 4 corresponding thereto is pressed-fitted and fixed. At this time, the first pin 3 corresponding to the rear through-hole 10 is press-fitted and fixed, and the second pin 4 corresponding thereto is loosely inserted.

In this case, when the first pin 3 engages with the corresponding pulleys 60 and 70, and the link plates 2 adjacent to each other in the chain movement direction X are bended, the second pin 4 comes into rolling and sliding contact with the first pin 3, and thus a bend between the link plates 2 is possible. At this time, when the rolling contact component is large and the sliding contact component is very small between the pair of first pin 3 and second pin 4, the first pin 3 hardly rotates about the corresponding pulleys 60 and 70, but comes into contact with the corresponding pulleys 60 and 70, and thus an abrasion loss is reduced. Accordingly, it is possible to ensure high power transmission efficiency.

Figure 12:
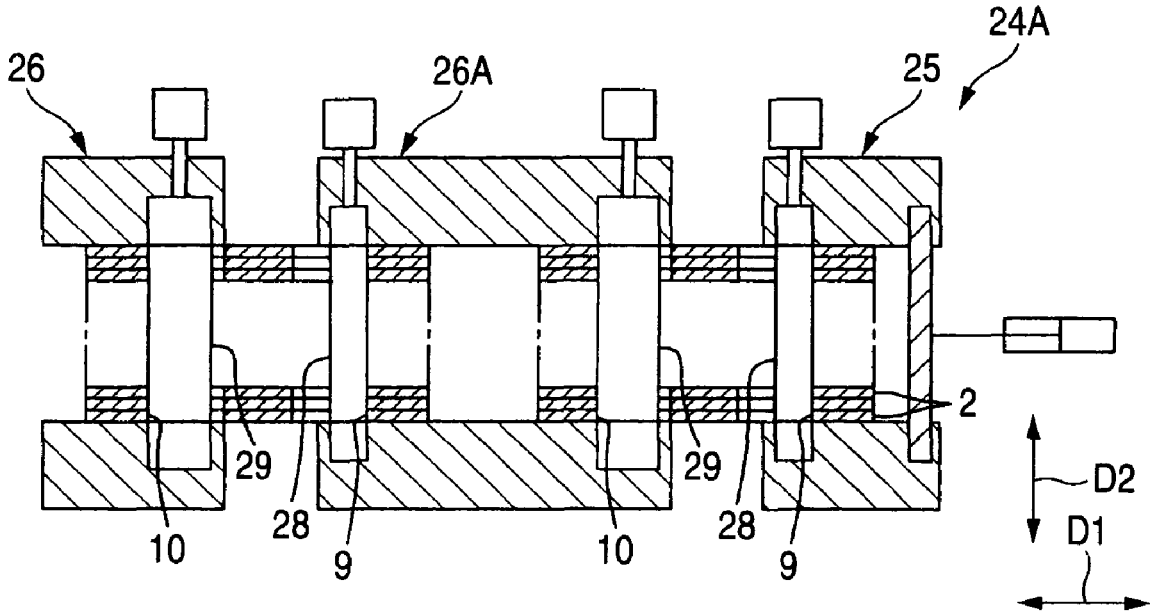
FIG. 12 is a partially sectional view schematically illustrating the pretension load device according to another embodiment of the invention.

Additionally, it is possible to load the pretension σp on the link plates 2 while being arranged in the first direction D1 using a pretension load device 24A shown in FIG. 12 instead of the pretension load device 24.

In this case, the pair of pins 28 and 29 are arranged in plural and the pair of driven members 26 and 26A are arranged in plural. The number of the link plates 2 which are inserted through the pair of pins 28 and 29 are configured to be the same as each other, and the pretension σp which is loaded on the link plates 2 is configured to be the same as each other.

At the time of loading the pretension σp, a movement of the pair of driven members 26 which are the furthest from the pair of drive members 25 are regulated in the first direction D1, and the other driven member 26A can relatively move in the first direction D1 with respect to both the pair of driven members 26 and the pair of drive members 25. The other pin 29 and one pin 28 are inserted through the driven member 26A, respectively.

In this case, it is possible to further increase the number of the link plates 2 on which the pretension σp is loaded at one time.

Figure 13:
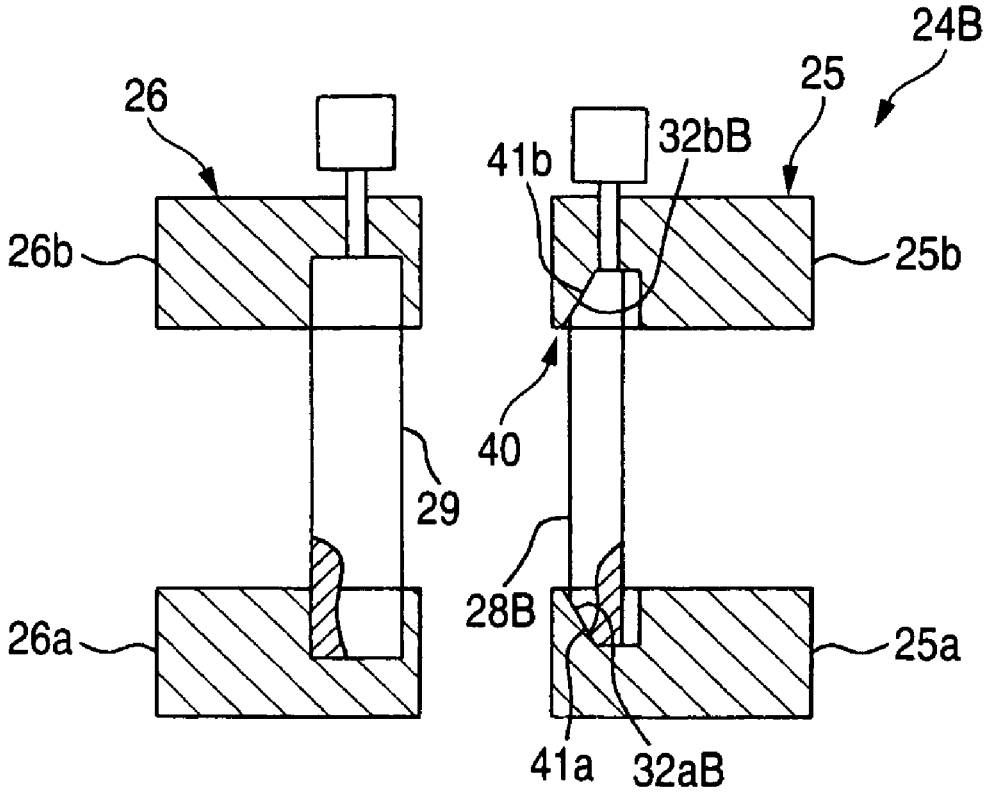
FIG. 13 is a partially sectional view schematically illustrating a configuration of the pretension load device according to still another embodiment of the invention.

FIG. 13 is a partially sectional view schematically illustrating a configuration of a pretension load device 24B according to another embodiment of the invention. Hereinafter, different points from the embodiment shown in FIGS. 1 to 11 will be mainly described. The same reference numbers are given to the same configurations, and the repetitive description is omitted.

As shown in FIG. 13, the embodiment is characterized in that a cam mechanism 40 serves as a tension mechanism for tensioning a pair of pins 28B and 29 to move away from each other.

The cam mechanism 40 includes a pair of insertion through-holes 32*a*B and 32*b*B formed in the pair of drive members 25, and a pair of slope surfaces 41*a* and 41*b* formed in both end portions of one pin 28B.

Each diameter of the insertion through-holes 32*a*B and 32*b*B decreases from the opening side to the bottom side and the axial line extends so as to be far away from the other pin 29. Each portion of the insertion through-holes 32*a*B and 32*b*B in the vicinity of the other pin 29 becomes far away from the other pin 29 from the opening side to the bottom side.

Each of the slope surfaces 41*a* and 41*b* includes a portion matching with circumferential surfaces of the insertion through-holes 32*a*B and 32*b*B, and each portion in the vicinity of the other pin 29 becomes far away from the other pin 29 toward the front end side.

Figure 14C:
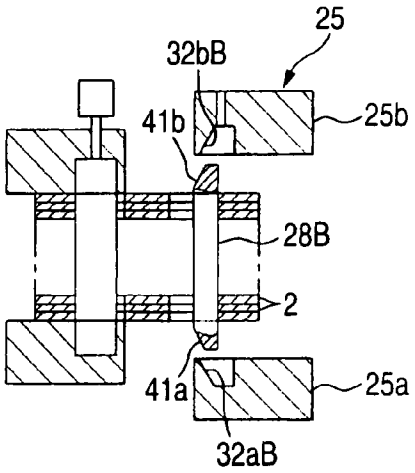
FIGS. 14A to 14E are views illustrating a state where the pretension load device shown in FIG. 13 loads pretension on the link plate.

A method of loading the pretension σp on the link plates 2 using the pretension load device 24B is carried out as below. That is, as shown in FIG. 14A, one driven member 26*a* and the other driven member 26*b* are made to move away from each other in the second direction D2, and the other pin 29 held by the other driven member 26*b* is inserted through the rear through-hole 10 of the link plate 2.

Figure 14B:
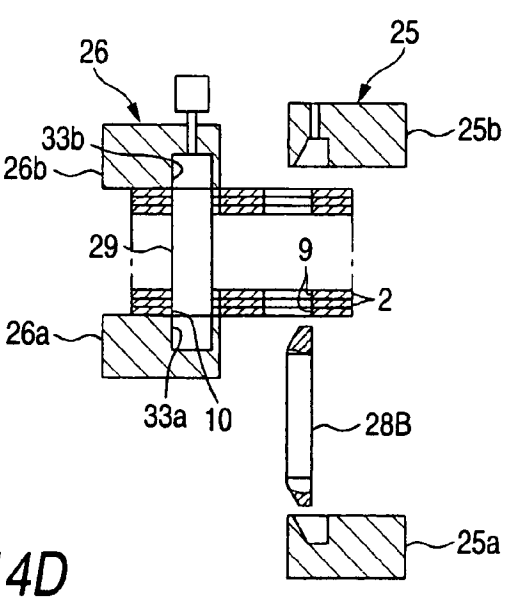
Figure 14A:
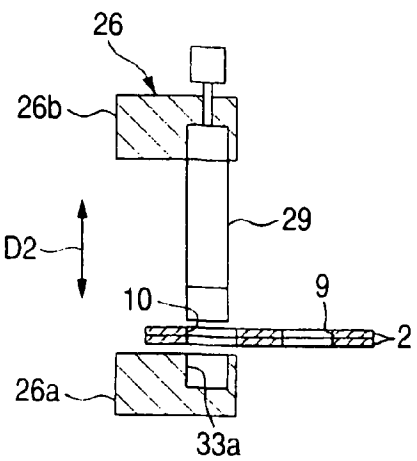

Subsequently, as shown in FIG. 14B, the other pin 29 is inserted through the insertion through-hole 33*a* of one driven member 26*a*, and then plural sheets of link plates 2 are clamped by the pair of driven members 26. Additionally, one pin 28B is inserted through the front through-holes 9 of the link plates 2.

As shown in FIG. 14C, the slope surfaces 41*a* and 41*b* of one pin 28B held by the link plates 2 are inserted through the corresponding insertion through-holes 32*a*B and 32*b*B of the pair of driven members 25, respectively. During the insertion-through operation, as shown in FIG. 14D, a force for inserting one pin 28B to the insertion through-holes 32*a*B and 32*b*B is converted into a force (tension F) for moving one pin 28B away from the other pin 29. Accordingly, one pin 28B and the other pin 29 move away from each other.

Figure 14E:
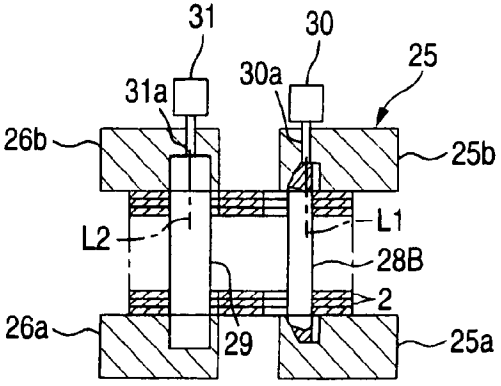
Figure 14D:
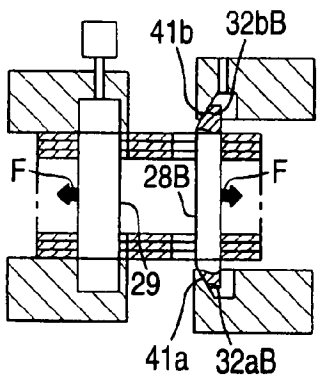

As shown in FIG. 14E, the output shaft 30*a* of the rotation mechanism 30 is connected to one pin 28B in the state where the link plates 2 are inserted between the pair of drive members 25, and the pair of pins 28B and 29 are turned around the axial lines L1 and L2, respectively.

According to the embodiment, it is possible to move the pair of pins 28B and 29 away from each other at the same time one pin 28B is inserted to the pair of drive members 25. Accordingly, it is possible to reduce a time for loading the pretension σp.

Figure 15:
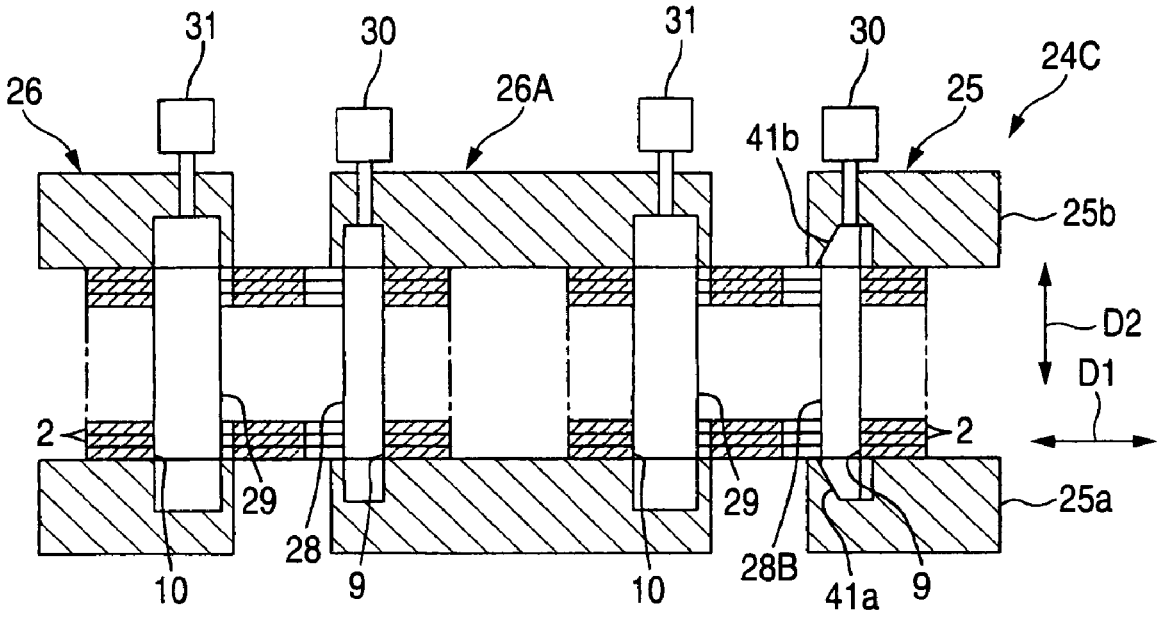
FIG. 15 is a partially sectional view schematically illustrating a configuration of the pretension load device according to still another embodiment of the invention.

The pretension σp may be loaded in the state where the link plates 2 are arranged in plural in the first direction D1 using a pretension load device 24C shown in FIG. 15 instead of the pretension load device 24B.

In this case, the pair of pins 28B and 29 (28 and 29) are arranged in plural and the pair of driven members 26 and 26A are arranged in plural. The number of the link plates 2 which are inserted through the pair of the pins 28B and 29 (28 and 29) are configured to be the same as each other, and the pretension σp which is loaded on the link plates 2 is configured to be the same as each other.

The slope surfaces 41*a* and 41*b* are formed only in one pin 28B which is inserted through the pair of drive members 25.

When the pretension σp is loaded, a movement of the pair of driven members 26 which are the furthest from the pair of drive members 25 is regulated in the first direction D1, and the other driven member 26A can relatively move in the first direction D1 with respect to both the pair of driven members 26 and the pair of drive members 25.

In this case, it is possible to further increase the number of the link plates 2 on which the pretension σp is loaded at one time.

Figure 16:
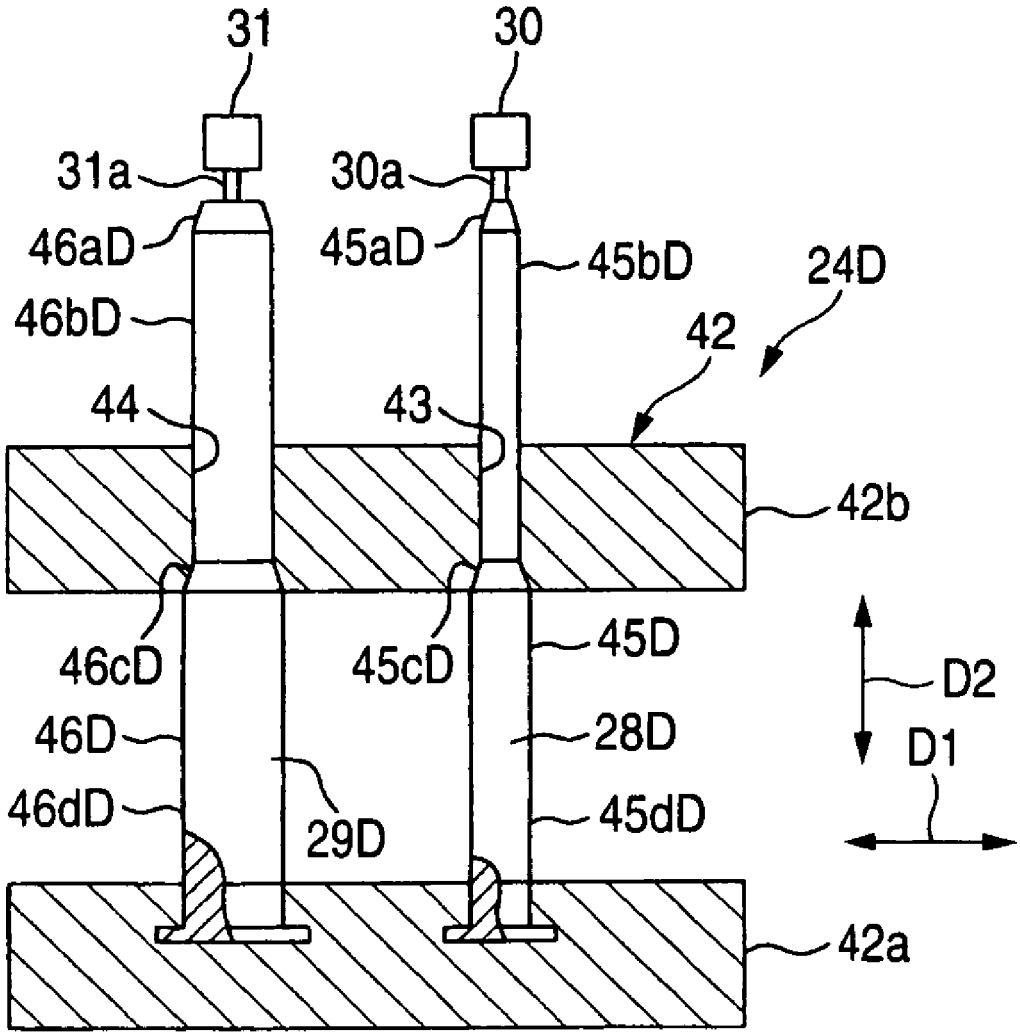
FIG. 16 is a partially sectional view schematically illustrating a configuration of the pretension load device according to still another embodiment of the invention.

FIG. 16 is a partially sectional view schematically illustrating a configuration of a pretension load device 24D according to still another embodiment of the invention.

As shown in FIG. 16, the pretension load device 24D includes a pair of opposed members 42 and a pair of pins 28D and 29D.

The pair of opposed members 42 are configured to be relatively movable in the second direction D2. One opposed member 42*a* holds the pair of pins 28D and 29D so as to be relatively movable and to be movable together in the first and second directions D1 and D2. The other opposed member 42*b* includes a pair of insertion through-holes 43 and 44 through which the pair of pins 28D and 29D are inserted.

Circumferential surfaces 45D and 46D of the pins 28D and 29D include chamfered portions 45*a* and 46*a*D formed at the front ends thereof, small-diameter portions 45*b*D and 46*b*D which are connected to the corresponding chamfered portions 45*a*D and 46*a*D, slope surfaces 45*c*D and 46*c*D which serve as cam mechanisms and which are connected to the corresponding the small-diameter portions 45*b*D and 46*b*D, and large-diameter portions 45*d*D and 46*d*D which are connected to the corresponding slope surfaces 45*c*D and 46*c*D.

The chamfered portions 45*a*D and 46*a*D serve as guide portions upon being inserted to the corresponding insertion through-holes 43 and 44 of the other opposed member 42*b*. The small-diameter portions 45*b*D and 46*b*D are configured to be larger (longer) than the corresponding large-diameter portions 45*d*D and 46*d*D in the second direction D2. The slope surfaces 45*c*D and 46*c*D, for example, are formed in a conical shape, and diameters become larger toward the base ends of the corresponding pins 28D and 29D.

Figure 17C:
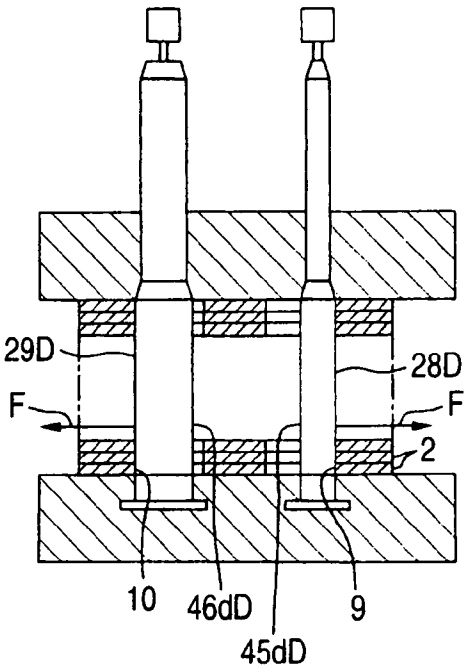
FIGS. 17A to 17C are views illustrating a state where the pretension load device shown in FIG. 16 loads pretension on the link plate.

A method of loading pretension on the link plates 2 using the pretension load device 24D is carried out as below. That is, as shown in FIG. 17A, first, the pair of opposed members 42 are made to move away from each other in the second direction D2, and the small-diameter portions 45*a*D and 46*a*D of the pair of pins 28D and 29D are inserted (loosely inserted) through the corresponding through-holes 9 and 10 of the link plates 2.

Figure 17B:
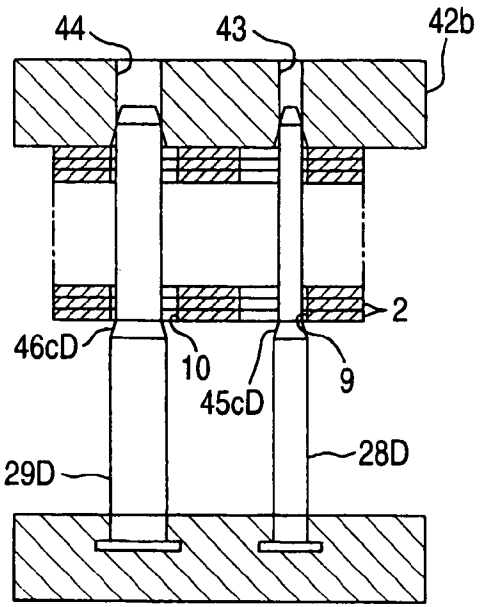
Figure 17A:
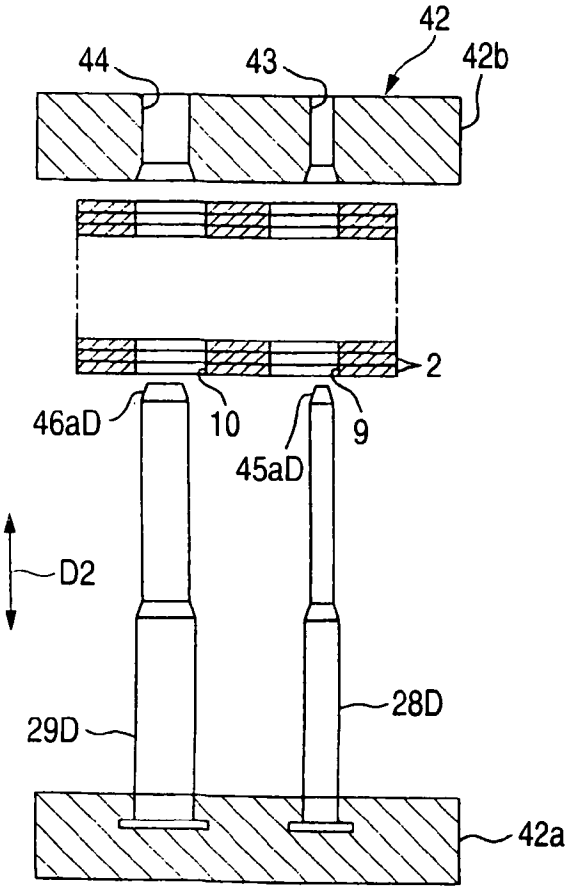

As shown in FIG. 17B, the pair of pins (28D and 29D) to which the link plates 2 are loosely inserted are inserted through the corresponding insertion through-holes 43 and 44 of the other opposed member 42*b*. At this time, the slope surfaces 45*c*D and 46*c*D of the pair of pins 28D and 29D come into contact with the peripheral edge portions of the through-holes 9 and 10 of the link plates 2. By this contact, a force for inserting the pair of pins 28D and 29D to the through-holes 9 and 10 of the link plates 2 is converted into a force (tension) for widening a distance between the through-holes 9 and 10.

As shown in FIG. 17C, the link plates 2 are press-fitted by the large-diameter portions 45*d*D and 46*d*D of the pair of pins 28D and 29D, so that the pretension σp is loaded on the link plates 2. In this state, the rotation mechanisms 30 and 31 drive the pair of pins 28D and 29D to rotate.

According to the embodiment, it is possible to widen a distance between the through-holes 9 and 10 at the time the pair of pins 28D and 29D are inserted to the corresponding through-holes 9 and 10 of the link plates 2. Accordingly, it is possible to reduce a time for loading the pretension σp.

Figure 18:
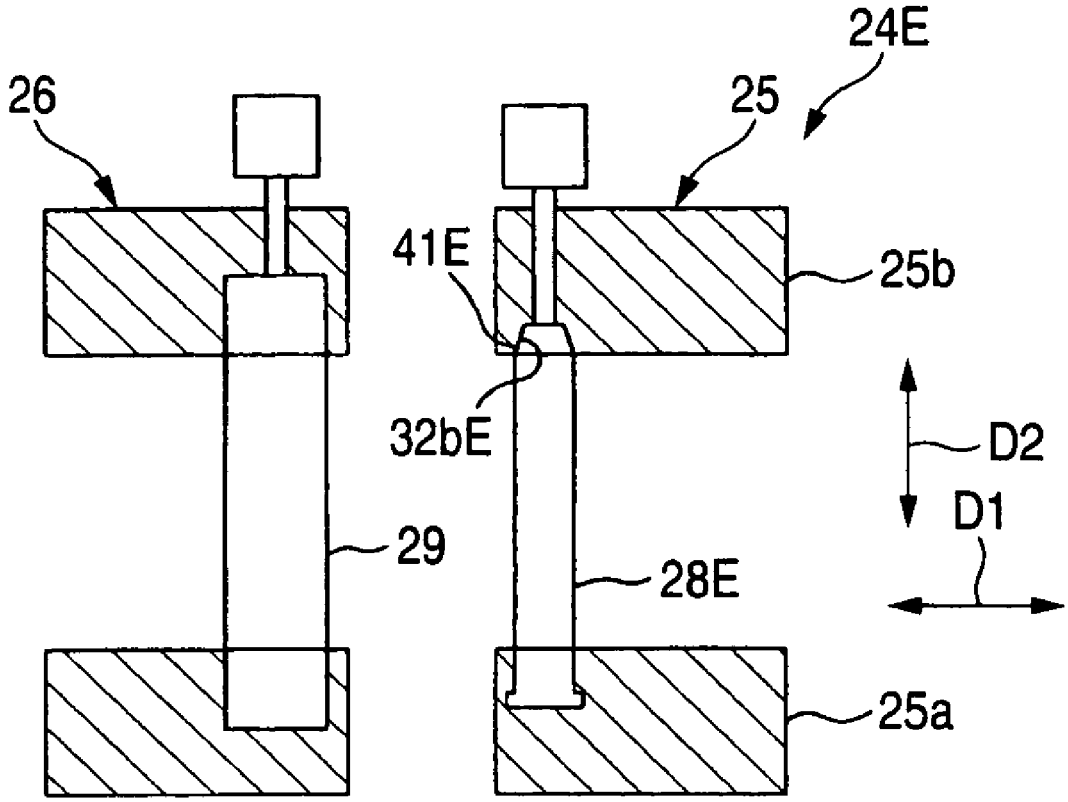
FIG. 18 is a partially sectional view schematically illustrating a configuration of the pretension load device according to still another embodiment of the invention.

FIG. 18 is a partially sectional view schematically illustrating a configuration of a pretension load device 24E according to still another embodiment of the invention.

As shown in FIG. 18, the embodiment is characterized in that a cam mechanism serves as a distance enlargement mechanism for widening a distance between a pair of through-holes of the link plate.

The cam mechanism includes a slope surface 41E formed in one end of one pin 28E. The slope surface 41E is formed in a taper shape in which a diameter decreases toward an insertion through-hole 32*b*E of the other drive member 25*b*.

One drive member 25*a* holds one pin 28E so as to be relatively rotatable and to be integrally movable in the first and second directions D1 and D2.

Figure 19C:
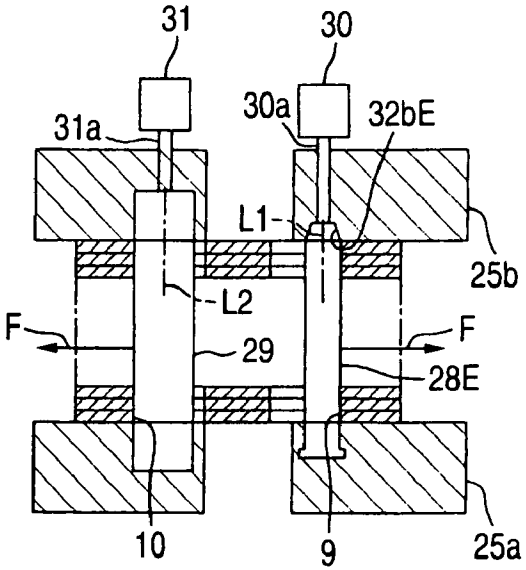
FIGS. 19A to 19C are views illustrating a state where the pretension load device shown in FIG. 18 loads pretension on the link plate.

A method of loading the pretension σp on the link plates 2 using the pretension load device 24E is carried out as below. That is, as shown in FIG. 19A, the pair of driven members 26 are made to move away from each other in the second direction D2, and the other pin 29 held by the other driven member 26*b* is inserted through the rear through-holes 10 of the link plates 2.

Figure 19B:
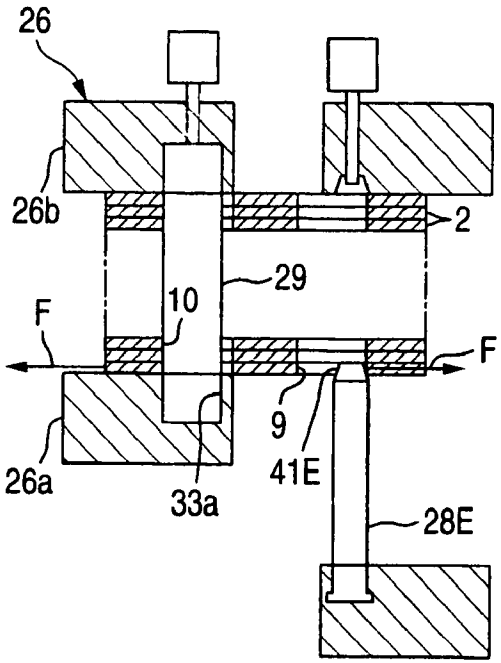
Figure 19A:
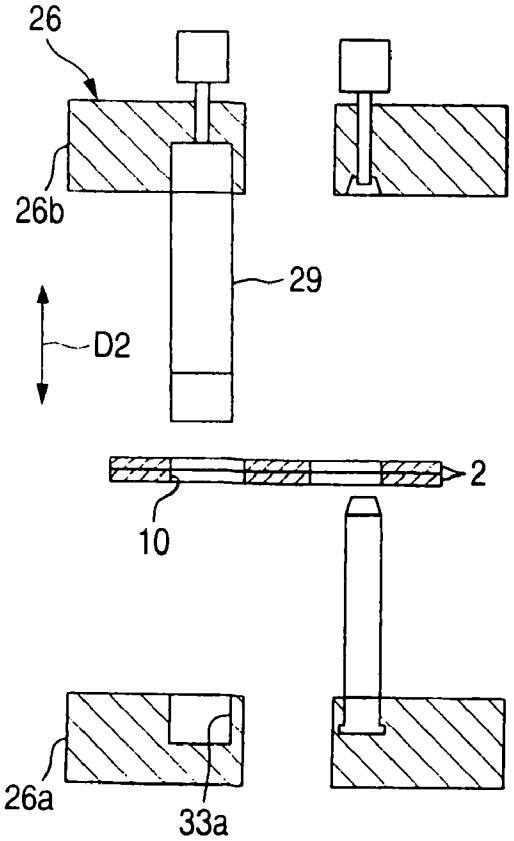

Subsequently, as shown in FIG. 19B, the other pin 29 is inserted through the insertion through-hole 33*a* of one driven member 26*a* so that the link plates 2 are clamped by the pair of driven members 26. One pin 28E is inserted to the front through-holes 9 of the link plates 2 which are inserted to the pair of driven members 26.

At this time, the slope surface 41E of one pin 28E comes into contact with the circumferential surfaces of the front through-holes 9 of the link plates 2, and a force for inserting one pin 28E to the front through-hole 9 is converted into a force (tension F) for widening a distance between the through-holes 9 and 10.

As shown in FIG. 19C, when one pin 28E is inserted to an insertion through-hole 32*b*E of the other drive member 25*b*, the tension F is uniformly loaded on the link plates 2. In this state, the output shaft 30*a* of the rotation mechanism 30 is connected to one end portion of one pin 28E so that the rotation mechanisms 30 and 31 turn the pins 28 and 29 around the axial lines L1 and L2, respectively.

According to the embodiment, the following effects and advantages are obtained. That is, it is possible to widen a distance between the through-holes 9 and 10 at the time one pin 28E is inserted to the front through-holes 9 of the link plates 2. Accordingly, it is possible to reduce a time for loading the pretension σp.

Figure 20:
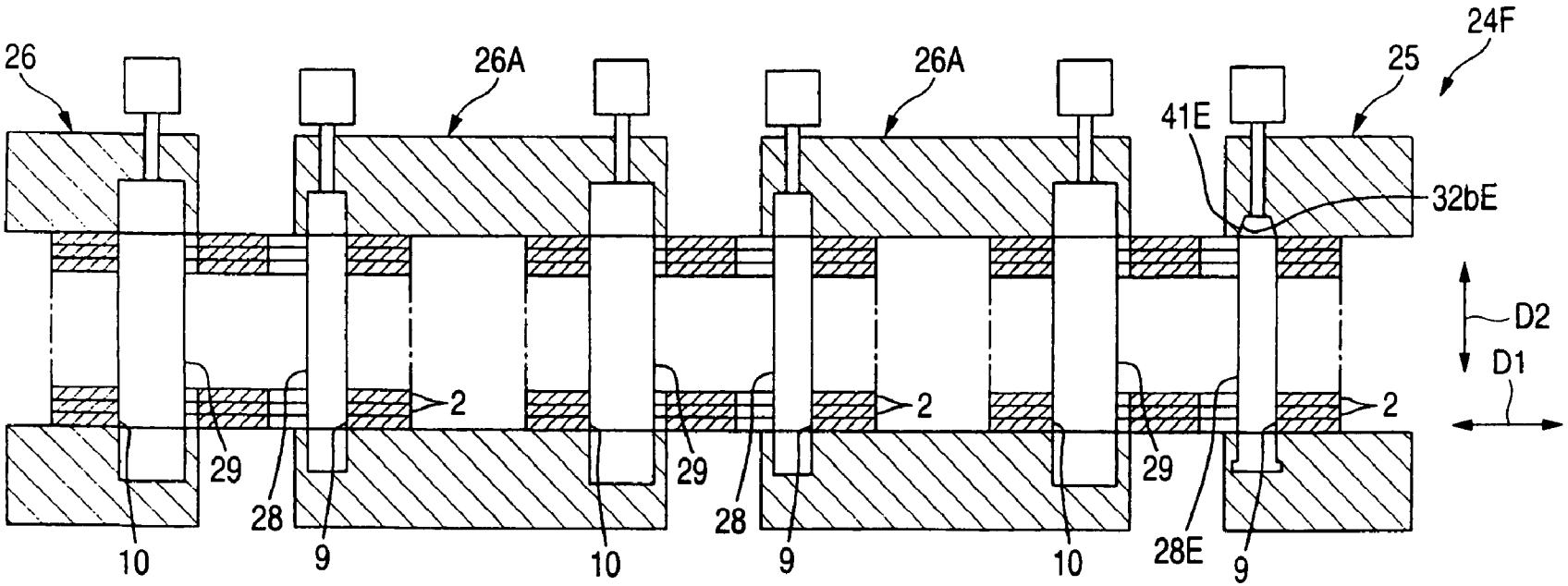
FIG. 20 is a partially sectional view schematically illustrating a configuration of the pretension load device according to still another embodiment of the invention.

The pretension σp may be loaded in the state where the link plates 2 are arranged in plural in the first direction D1 using a pretension load device 24F shown in FIG. 20 instead of the pretension load device 24E.

In this case, the pair of pins 28E and 29 (28 and 29) are arranged in plural and the pair of driven members 26 and 26A are arranged in plural. The numbers of the link plates 2 which are inserted through the pair of the pins 28E and 29 (28 and 29) are configured to be the same as each other, and the pretension σp which is loaded on the link plates 2 is configured to be the same as each other.

A slope surface 41E is formed only in one pin 28E which is inserted through the drive members 25.

When the pretension σp is loaded, a movement of the pair of driven members 26 which are the furthest from the pair of drive members 25 is regulated in the first direction D1, and the other driven member 26A can relatively move in the first direction D1 with respect to both the pair of driven members 26 and the pair of drive members 25.

In this case, it is possible to further increase the number of the link plates 2 on which the pretension σp is loaded at one time.

Figure 21:
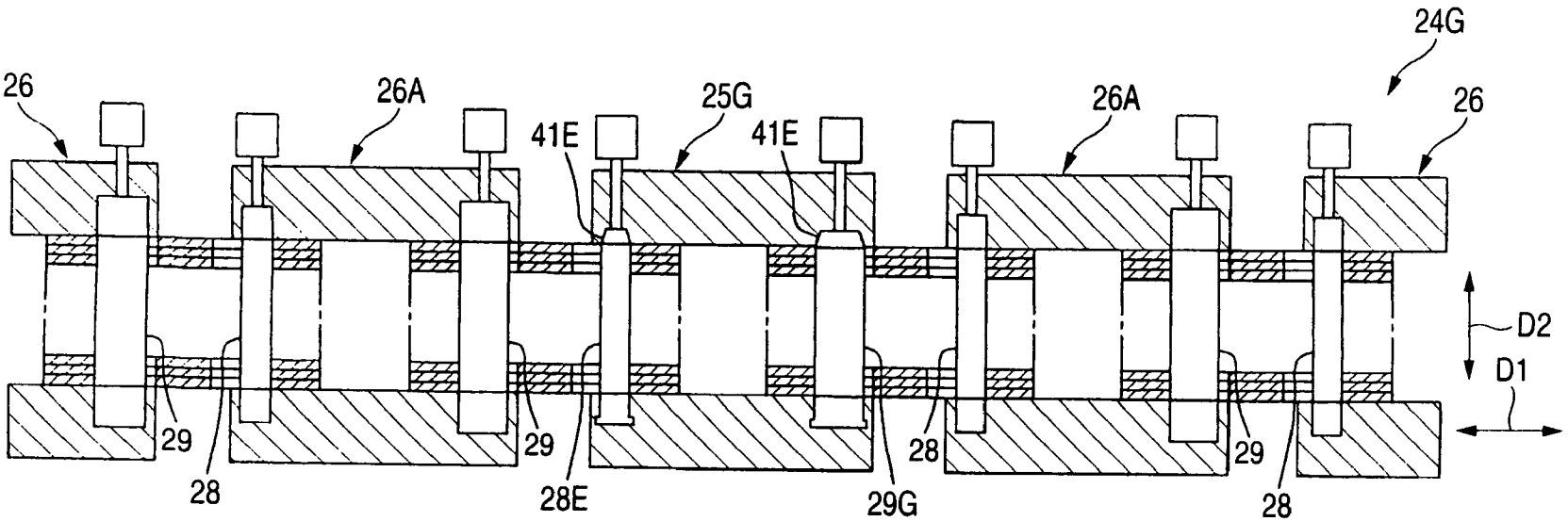
FIG. 21 is a partially sectional view schematically illustrating a configuration of the pretension load device according to still another embodiment of the invention.

A pretension load device 24G shown in FIG. 21 may be used instead of the pretension load device 24F shown in FIG. 20. In the pretension load device 24G, a pair of driven members 26 and 26A are disposed in both sides of a pair of drive members 25G in the first direction D1. In the pair of drive members 25G, slope surfaces 41E are formed in one pin 28E and the other pin 29G, respectively.

In the embodiments described above, it is possible to load the pretension σp by loading the tension F in the state where three or more link plates 2 are arranged in the first direction D1.

Additionally, the invention is not limited to a configuration in which a pair of pins of the pretension load device are arranged in parallel in the second direction D2, but may be configured such that one side or both sides of the pair of pins are obliquely disposed in the second direction D2.

Figure 22:
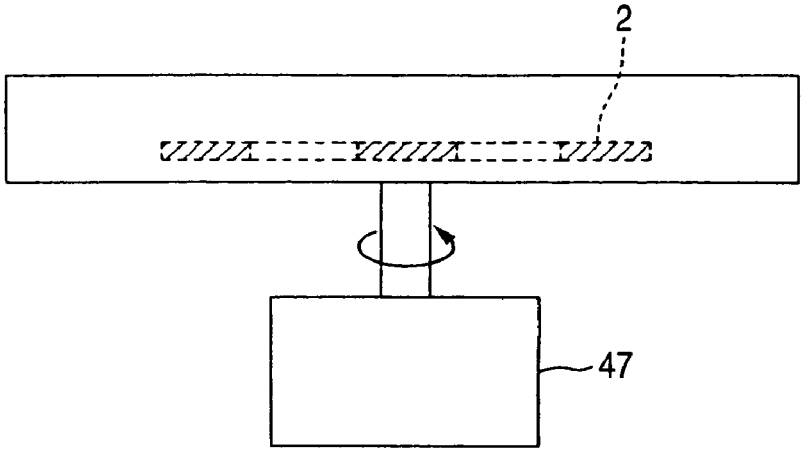
FIG. 22 is a view illustrating a state where a barrel polishing device loads pretension on the link plate.
Figure 23:
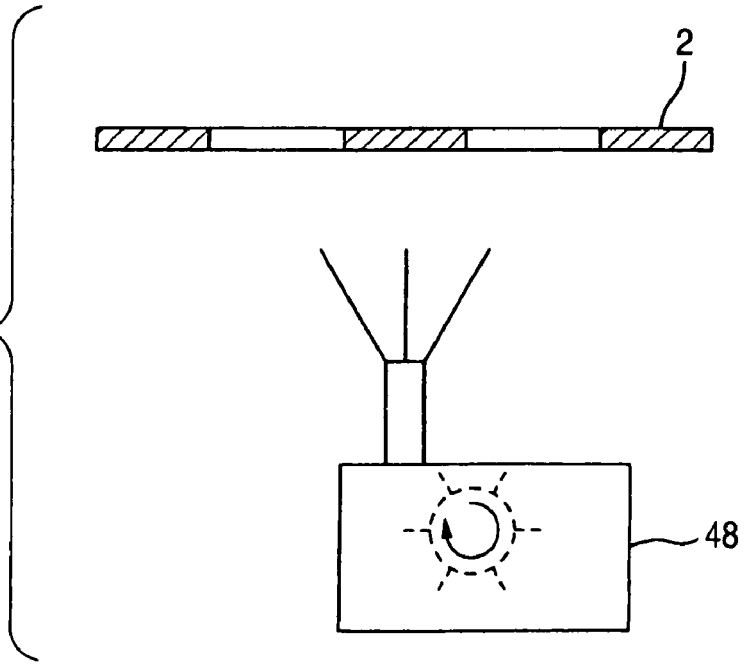
FIG. 23 is a view illustrating a state where a shot blast device loads pretension on the link plate.

A step of performing a barrel polishing on the link plate 2 using a barrel polishing device 47 shown in FIG. 22 and a step of perform g a shot blasting on the link plate 2 using a shot blast device 48 shown in FIG. 23 may be provided instead of the step of performing the shot peening shown in FIG. 10 or in series to the step of performing the shot peening.

Examples of the barrel polishing device 47 shown in FIG. 22 include a vortex barrel polishing device, a vibration barrel polishing device, a rotation barrel polishing device, and a dry barrel polishing device.

Additionally, the number of the link plates 2 may be the same in each link unit in the chain 1.

Figure 24:
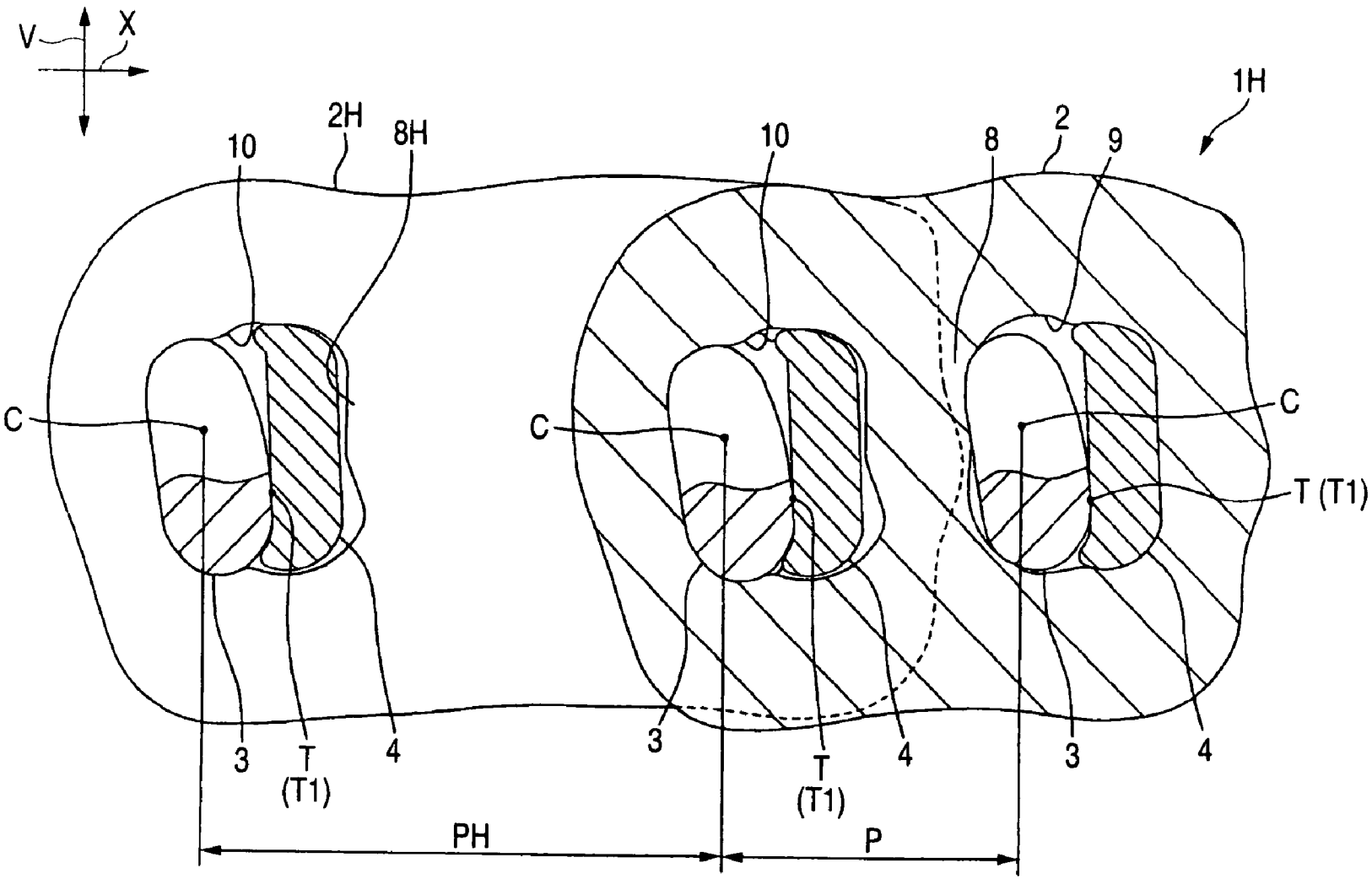
FIG. 24 is a partially sectional view illustrating a main part of the chain according to still another embodiment of the invention.

As shown in FIG. 24, a chain 1H may be formed by various types of link plates 2 and 2H of which the lengths are different from each other in the chain movement direction X. In this case, the pretension σp is loaded on the link plate 2 and the link plate 2H at a different time.

An arrangement pitch P of the link plate 2 is configured to be relatively short, and an arrangement pitch PH of the link plate 2H is configured to be relatively long. The arrangement pitch means a distance between contact center points C between the first pins 3 which are adjacent to each other in a chain line region.

The link plate 2H is configured so that the length of a column portion 8H in the chain movement direction X is relatively long, and the link plate 2 is configured so that the length of a column portion 8 in the chain movement direction X is relatively short.

The link plate 2 and the link plate 2H are randomly arranged in the chain movement direction X. In this case, "random arrangement" means that at least one of the link plates 2 and 2H is irregularly arranged in at least a partial region in the chain movement direction X. Additionally, "irregularity" means that at least one of periodicity and regularity does not exist.

The link plate 2 and the link plate 2H may be randomly arranged in a whole region of the chain movement direction X of the chain 1.

As an example of the random arrangement, the link plate 2 and the link plate 2H are arranged in order of 2H, 2, 2, 2H, 2, 2, 2, 2H, 2, 2, 2, 2, 2, 2H, 2, 2, 2, 2, 2, 2 . . . in the chain movement direction X.

According to the embodiment, since the pretension σp is uniformly loaded on the link plates 2 and 2H, it is possible to uniformly obtain a strength improvement effect of the link plates 2 and 2H thanks to the pretension σp.

That is, even at the time of using a plurality of link plates 2 and 2H in which the arrangement pitches are different from each other, it is possible to prevent the pretension σp loaded on the link plates 2 and 2H from being non-uniform.

Additionally, since the link plates 2 and 2H, the arrangement pitches P and PH of which are different from each other, are randomly arranged in the chain movement direction X, at the time of driving the chain 1H, it is possible to allow the engagement cycle between the chain 1H and the pulleys 60 and 70 to be random. Accordingly, an engagement sound generation cycle between the chain 1H and the pulleys 60 and 70 is random, and thus it is possible to broadly distribute a frequency of the engagement sound and to reduce a noise caused by the drive of the chain 1H.

Additionally, in the embodiments, the second pin 4 may engage with the pulleys 60 and 70. Further, the second pin 4 may be loosely inserted to the front through-hole 9, and the first pin 3 may be loosely inserted to the rear through-hole 10.

The invention may be applied to a so-called block type chain including a power transmission block fixed by a pin etc. so as to protrude from both sides of the chain width direction.

The invention is not limited to an example in which each groove width of both the drive pulley 60 and the driven pulley 70 is changed, but may be an example in which one groove width is changed and the other groove width is fixed so as not to be changed. As described above, it is described about an example in which the groove width is changed in a continuous (stepless) manner, but the invention may be applied to another power transmission apparatus of which the groove width is changed in a gradual manner or in a fixed (non-variable) manner.

While exemplary embodiments of the invention are described above, the invention is not limited to the exemplary embodiments, but may be modified into various forms within a scope described in Claims.

What is claimed is:

1. A method of manufacturing a power transmission chain including a plurality of link plates which are arranged in a chain movement direction and a plurality of connection members which bendably connect the plurality of link plates to each other, the method comprising:

loading a force for widening a distance between a pair of through-holes by a pair of pins, the pair of pins being inserted through the pair of through-holes in a state where one sheet of the link plate comprising the pair of through-holes is disposed or plural sheets of the link plates comprising the pair of through-holes are laminated so as to load pretension to generate a predetermined compressive residual stress on the one sheet of the link plate or plural sheets of the link plates;

extracting the pair of pins from the link plate or plural sheets of the link plates; and inserting the connection members through corresponding through-holes of the plurality of link plates on which the pretension is loaded so as to assemble the power transmission chain.

2. The method according to claim 1, wherein, during the loading of the pretension, each pin is rotated in a circumferential direction of an axial line thereof.

3. The method according to claim 1, further comprising performing at least one of a barrel polishing, a shot blasting, and a shot peening on the link plate between the extracting and assembling.

4. A pretension load device comprising:

a pair of pins which are inserted through a pair of through-holes of a link plate;

a pin holding structure into which an end of at least a pin of the pair of pins is disposed; and a distance enlargement mechanism which widens a distance between the pair of through-holes by imparting a force on the pair of pins.

5. The pretension load device according to claim 4, wherein the distance enlargement mechanism includes a tension mechanism which tensions the pair of pins in a direction moving away from each other.

6. The pretension load device according to claim 4, wherein the distance enlargement mechanism includes a cam mechanism which converts a force for inserting at least one of the pair of pins to the corresponding through-hole of the link plate into a force for widening a distance between the pair of through-holes.

7. The pretension load device according to claim 4, further comprising:

a rotation mechanism which rotates a pin of the pair of pins in a circumferential direction of an axial line thereof.

8. The pretension load device according to claim 4, wherein a pin of the pair of pins disposed in the pin holding structure is fixed relative to another pin of the pair of pins.

9. The pretension load device according to claim 4, further comprising:

a base comprising a hole into which a pin of the pair of pins is inserted, wherein a distal end of the pin comprises a tapered end portion, the tapered end portion being aligned with the hole such that the tapered end portion overlaps an edge of the hole before insertion.

10. The pretension load device according to claim 4, further comprising:

at least an other link, including a pair of through-holes;

an other pin connected to the pin holding structure and inserted through a through-hole of the pair of through-holes of the other link; and a further pin connected to another pin holding structure and inserted into another through-hole of the pair of through-holes of the other link.

11. The pretension load device according to claim 4, further comprising:

at least an other link, including a pair of through-holes; and an other pin connected to an other pin holding structure and inserted through the pair of through-holes of the other link.

12. A pretension load device comprising:

a pair of pins which are inserted through a pair of through-holes of a link plate;

a distance enlargement mechanism which widens a distance between the pair of through-holes using the pair of pins; and a base comprising an insertion through-hole through which one of the pair of pins is inserted, wherein the distance enlargement mechanism includes a tension mechanism which tensions the pair of pins in a direction moving away from each other, and wherein the tension mechanism includes a drive mechanism which drives the base in a direction where one pin moves away from another pin of the pair of pins.

13. A pretension load device comprising:

a pair of pins which are inserted through a pair of through-holes of a link plate;

a distance enlargement mechanism which widens a distance between the pair of through-holes using the pair of pins; and a base comprising an insertion through-hole through which one of the pair of pins is inserted, wherein the distance enlargement mechanism includes a tension mechanism which tensions the pair of pins in a direction moving away from each other, and wherein the tension mechanism includes a cam mechanism which converts a force for inserting one pin to the insertion through-hole of the base into a force for moving the one pin away from another pin of the pair of pins.

* * * * *